US008701948B2

(12) United States Patent
Paiva et al.

(10) Patent No.: US 8,701,948 B2
(45) Date of Patent: Apr. 22, 2014

(54) STOPPER ROD POSITIONING AND CONTROL APPARATUS FOR CONTROL OF MOLTEN METAL FLOW THROUGH A NOZZLE

(75) Inventors: Marcelo Albano Paiva, Willingboro, NJ (US); Dale William Vetter, Burlington, NJ (US); William Robert Pflug, Mt. Laurel, NJ (US)

(73) Assignee: Inductotherm Corp., Rancocas, NJ (US)

( * ) Notice: Subject to any disclaimer, the term of this patent is extended or adjusted under 35 U.S.C. 154(b) by 363 days.

(21) Appl. No.: 12/776,991

(22) Filed: May 10, 2010

(65) Prior Publication Data

US 2010/0282784 A1 Nov. 11, 2010

Related U.S. Application Data

(60) Provisional application No. 61/176,922, filed on May 10, 2009.

(51) Int. Cl.
*B22D 41/08* (2006.01)

(52) U.S. Cl.
USPC ..... 222/602; 266/236

(58) Field of Classification Search
USPC ..... 222/594, 602, 607; 164/437, 457, 133, 164/337; 266/236
See application file for complete search history.

(56) References Cited

U.S. PATENT DOCUMENTS 4,953,761 A * 9/1990 Fishman et al. ..... 222/602
5,333,764 A * 8/1994 Kassuba ..... 222/602
6,575,224 B1 6/2003 Hetherington

FOREIGN PATENT DOCUMENTS

JP 08-168854 A 7/1996
KR 10-0832998 B1 5/2008

* cited by examiner

*Primary Examiner* — Scott Kastler
*Assistant Examiner* — Michael Aboagye
(74) *Attorney, Agent, or Firm* — Philip O. Post

(57) ABSTRACT

A stopper rod positioning and control apparatus is provided for controlling the flow of a molten metal out of a bottom nozzle in a metal reservoir. The stopper rod can be aligned with the nozzle's opening by selectively rotating a pair of roller (ring) bearings that are centerline offset from each other along a first axis around which one end of an extended structural arm can pivot where the opposing end of the arm retains the stopper rod along a second axis parallel to the first axis. When the appropriate relative positions of the pair of roller bearings are located for a nozzle-centered stopper rod, the second axial position of the stopper rod is fixed by retaining the appropriate relative positions with a brake mechanism. In a dual nozzle bottom pour reservoir of molten metal a separate stopper rod positioning and control apparatus is provided for each of the two nozzles while a dual nozzle assembly may be utilized to facilitate replacement of a worn nozzle or alter the distances between the centers of the two nozzles.

18 Claims, 18 Drawing Sheets

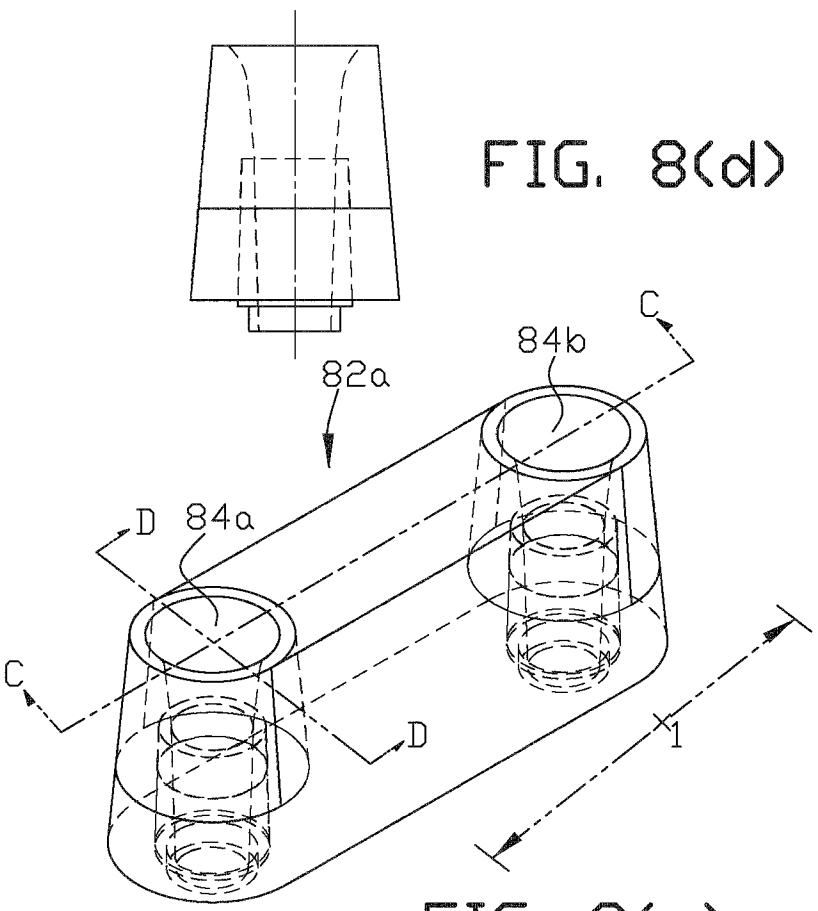
FIG. 8(a)
FIG. 8(d)
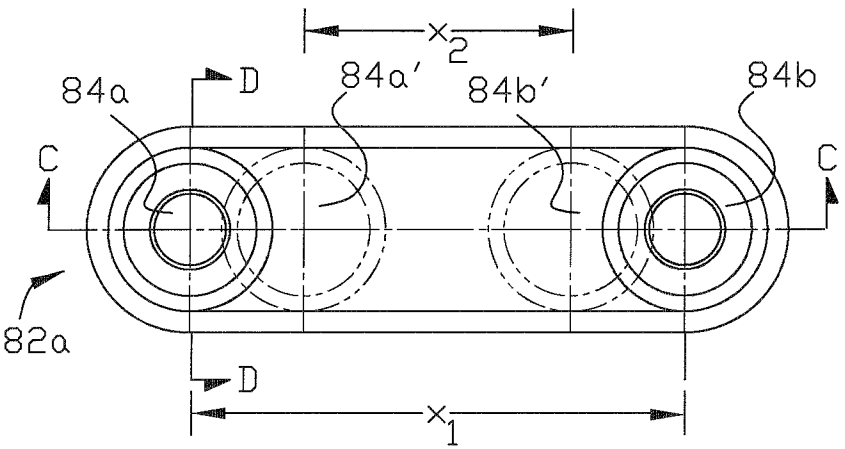
FIG. 8(b)
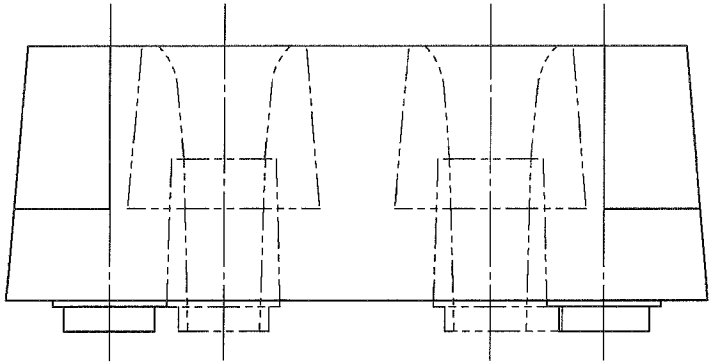
FIG. 8(c)

STOPPER ROD POSITIONING AND CONTROL APPARATUS FOR CONTROL OF MOLTEN METAL FLOW THROUGH A NOZZLE

CROSS REFERENCE TO RELATED APPLICATIONS

This application claims the benefit of U.S. Provisional Application No. 61/176,922 filed May 10, 2009, which is hereby incorporated by reference in its entirety.

FIELD OF THE INVENTION

The present invention relates to a stopper rod positioning and control apparatus used to control the flow of a molten metal from a reservoir of the metal through a bottom pour nozzle, and to applications of such apparatus particularly when dual nozzles are used in the same reservoir for dual pour applications.

BACKGROUND OF THE INVENTION

U.S. Pat. No. 4,953,761, which is incorporated herein by reference in its entirety, discloses a stopper rod spatial control mechanism that is used to control the gravity flow of a molten metal through a nozzle. Alignment of the stopper rod with the nozzle in the disclosed mechanism is achieved by rotating the boom of the mechanism about the defined longitudinal axis Y-Y and swinging the boom about the defined longitudinal axis Y'-Y', which is offset from the Y-Y axis. While this arrangement provides a satisfactory method of adjustment, accomplishing the alignment via the rotational moment arm established between the offset pair of axes has disadvantages.

It is one object of the present invention to provide a stopper rod positioning and control apparatus that has at least one method of precision alignment of the stopper rod with the nozzle that is achieved about a single longitudinal axis with no rotational moment arm. It is another object of the present invention to provide additional methods of precision alignment of the stopper rod with the nozzle that can be achieved in combination with a method of precision alignment of the stopper rod with the nozzle that is achieved about a single longitudinal axis.

It is another object of the present invention to provide at least two stopper rod positioning and control apparatus that have at least one method of precision alignment of the stopper rod with the nozzle that is achieved about a single longitudinal axis with no rotational moment arm, and are used to control the flow of molten metal through multiple nozzles situated in a common reservoir of molten metal.

BRIEF SUMMARY OF THE INVENTION

In one aspect the present invention is apparatus for, and method of, controlling the flow of molten metal out of a bottom pour launder or other reservoir of molten metal. A stopper rod positioning and control apparatus is provided for controlling the flow of the metal out of the bottom nozzle in the launder. The stopper rod can be aligned with the nozzle's opening by selectively rotating a pair of roller bearings that are centerline offset from each other along a first axis around which one end of an extended structural arm can pivot. The opposing end of the arm retains the stopper rod along a second axis substantially parallel to the first axis. When the appropriate relative positions of the pair of roller bearings are located for a nozzle-centered stopper rod, the second axial position of the stopper rod is fixed by retaining the appropriate relative positions of the roller bearings with a brake mechanism. In a dual nozzle bottom pour reservoir of molten metal a separate stopper rod positioning and control apparatus is provided for each of the two nozzles while a dual nozzle assembly may be utilized to facilitate replacement of worn nozzles or alter the distances between the centers of the two nozzles.

In another aspect the present invention is a stopper rod positioning and control apparatus for control of molten metal flow through a nozzle disposed in the bottom of a molten metal holding reservoir. A lift apparatus is centered on a substantially vertically oriented longitudinal axis. The lift apparatus has an inner tube telescopically mounted within an outer tube, and the inner tube is reciprocally movable along the longitudinal axis. A servomotor is mounted at a lower end of the outer tube. The servomotor has a servomotor output interconnect to the inner tube whereby actuation of the servomotor results in reciprocal movement of the inner tube along the longitudinal axis. A lower ring bearing has a lower ring bearing outer race and a lower ring bearing inner race, and the central axis of the lower ring bearing is offset from the substantially vertically oriented longitudinal axis. The lower ring bearing outer race is suitably fixed to the telescoping end of the inner tube. An upper ring bearing has an upper ring bearing outer race and an upper ring bearing inner race, and the central axis of the upper ring bearing is offset from the longitudinal axis and the central axis of the lower ring bearing. The upper ring bearing outer race is suitably fixed to the lower ring bearing inner race, and is rotatable with the lower ring bearing inner race. A locking plate is suitably fixed to the upper ring bearing inner race and rotatable with the upper ring bearing inner race about the central axis of the upper ring bearing. A brake assembly has a means for locking the locking plate in position to inhibit rotation of the locking plate. An arm has a first arm end and a second arm end, with the first arm end suitably fixed to the locking plate and rotatable about the central axis of the upper ring bearing. The second arm end extends at least in the horizontal direction away from the longitudinal axis. A stopper rod is supported from the second end of the arm. The stopper rod is aligned with the nozzle by the combined movements of rotating the lower ring bearing inner race about the central axis of the lower ring bearing and rotating the upper ring bearing inner race to an aligned stopper rod position, then fixing the aligned stopper rod position by the brake mechanism, and thereafter reciprocally moving the stopper rod above the nozzle by actuation of the servomotor.

In another aspect the present invention is a stopper rod positioning and control apparatus for control of molten metal flow through a nozzle disposed in the bottom of a molten metal holding reservoir. An outer tube has a substantially vertically oriented longitudinal axis. An inner tube is telescopically mounted within the outer tube, and the inner tube is reciprocally movable along the substantially vertically oriented longitudinal axis. A lower ring bearing has a lower ring bearing outer race and a lower ring bearing inner race. The central axis of the lower ring bearing is offset from the substantially vertically oriented longitudinal axis, and the lower ring bearing outer race is suitably fixed to the telescoping end of the inner tube. An upper ring bearing has an upper ring bearing outer race and an upper ring bearing inner race. The central axis of the upper ring bearing is offset from the substantially vertically oriented longitudinal axis and the central axis of the lower ring bearing. The upper ring bearing outer race is suitably fixed to the lower ring bearing inner race and is rotatable with the lower ring bearing inner race. An arm has a first arm end and a second arm end, with the arm affixed to the upper ring bearing inner race adjacent to the first arm end, and is rotatable about the central axis of the upper ring bearing inner race. A stopper rod is supported from the second end of the arm, and a means for locking the inner race of the upper ring bearing in a fixed position is provided. The stopper rod is aligned with the nozzle by the combined movements of rotating the lower ring bearing inner race about the central axis of the lower ring bearing and rotating the upper ring bearing inner race to an aligned stopper rod position, then the aligned stopper rod position is fixed by the means for locking the inner race of the upper ring bearing.

In some examples of the invention an X-Y table can be provided as a means for aligning the stopper rod with a nozzle. In other examples of the invention a linear extension element can be provided for extending the distance between the second arm end and the stopper rod as a means for aligning the stopped rod with a nozzle.

In another aspect of the present invention a pair of the stopper rod positioning and control apparatus of the present invention can be used in a system for controlling the flow of a molten metal in a dual pour process. A common molten metal holding reservoir is provided. A pair of spaced-apart nozzles is disposed in the bottom of the molten metal holding reservoir. In some examples of the invention the two spaced-apart nozzles are contained within a unitary dual nozzle block, and the spaced-apart distance between the pair of spaced-apart nozzles can be changed and accommodated in a unitary dual nozzle block having identical overall dimensions.

The above and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings:

FIG. 5(*b*) is an isometric view of one example of the lift apparatus used in the stopper rod positioning and control mechanism shown in FIG. 5(*a*).

FIG. 7(*b*) is a partial elevational view of two stopper rod positioning and control apparatus of the present invention with a separate stopper rod clamped to each apparatus and a launder with a unitary dual bottom pour nozzle block.

FIG. 7(*c*) through FIG. 7(*e*) illustrate one example of filling a mold with a molten metal from a bottom pour reservoir of molten metal.

FIG. 8(*a*) is an isometric view of one example of a unitary dual nozzle block used in one example of the present invention; FIG. 8(*b*) is at top plan view of the dual nozzle block shown in FIG. 8(*a*); FIG. 8(*c*) is a cross sectional elevation view of the nozzle block through line C-C in FIG. 8(*b*); and FIG. 8(*d*) is a cross sectional elevation view of the nozzle block through line D-D in FIG. 8(*b*).

FIG. 9(*c*) geometrically illustrates a typical but non-limiting range of centering adjustment that can be achieved with the stopper rod components shown in FIG. 9(*a*) and FIG. 9(*b*).

DETAILED DESCRIPTION OF THE INVENTION

There is shown in FIG. 1 through FIG. 6 one example of a stopper rod positioning and control apparatus 10 of the present invention.

Figure 5A:
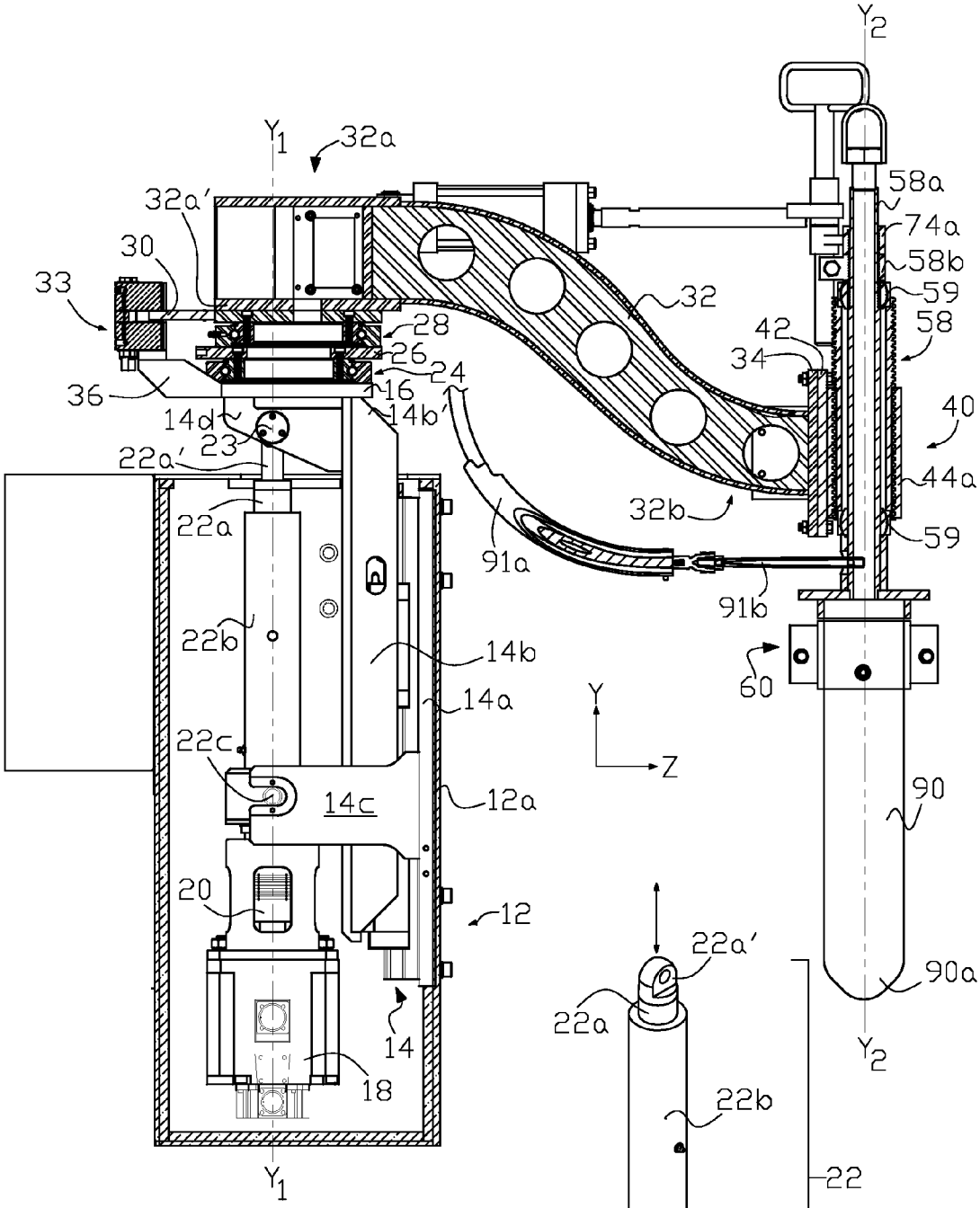
FIG. 5(*a*) is a cross sectional elevation view of the stopper rod positioning and control mechanism shown in FIG. 1 through line A-A in FIG. 4.
Figure 5B:
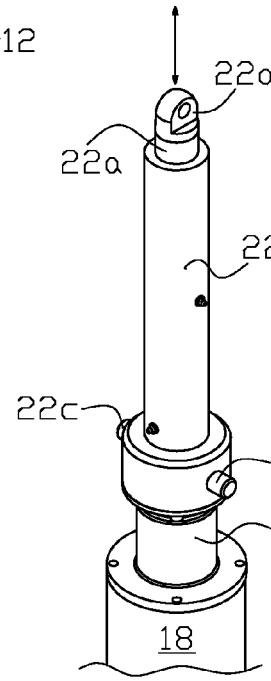

The term servoactuator assembly refers to all components located along longitudinal axis $Y_1$-$Y_1$ (FIG. 5(*a*)) from servomotor 18 to locking plate 30, and also linear guide assembly 14, which is longitudinally offset from axis $Y_1$-$Y_1$. Various components of the servoactuator assembly may be installed in a protective enclosure such as generally rectangular enclosure 12 as shown in the drawings.

Stationary base 14*a* of linear guide assembly 14 is suitably attached to wall 12*a* of enclosure 12 or other suitable stationary structure. Sliding element 14*b* of the linear guide assembly is slidably attached to stationary base 14*a* and is free to move in the Y-direction while being slidably retained within the stationary base. Mounting plate 16 is attached to, and supported at opposing ends by, the upper end 14*b*' of sliding element 14*b* and slide angle support 14*d* that extends from the upper end of sliding element 14*b* across longitudinal axis $Y_1$-$Y_1$.

The output shaft of servomotor 18 is suitably connected to the bottom input of lift apparatus 22. In this non-limiting example the output shaft of servomotor 18 is mechanically adapted to the input of lift apparatus 22 by coupling adaptor 20. In operation, activation of bidirectional electric servomotor 18 results in inner tube 22*a* either extending up and out of stationary tube 22*b*, or down and into the stationary tube in a reciprocally telescoping motion. In one example of the present invention lift apparatus 22 comprises a ball screw drive assembly contained within the enclosure of the lift apparatus. Other types of in-line drives may also be employed such as a hydraulic or pneumatic lift in place of the servomotor and the lift apparatus. Eye rod 22*a*' is attached to the upper end of the inner tube 22*a*, and is suitably fastened to slide angle support 14*d*, for example, via pin 23. Since the outer race of the lower ring bearing is attached to mounting plate 16, the mounting plate provides an intermediate connection between the outer race of the lower bearing and the inner tube. Inner tube 22*a* is vertically and reciprocally movable along the $Y_1$-$Y_1$ axis, and may optionally be rotatable about the $Y_1$-$Y_1$ axis.

Lateral support arms 14*c* extend from base 14*a* and wall 12*a* and are attached on opposing sides to clevis pins 22*c* on lift apparatus 22. Lateral support arms 14*c* support the weight of the servoactuator assembly in this example of the invention.

Figure 1:
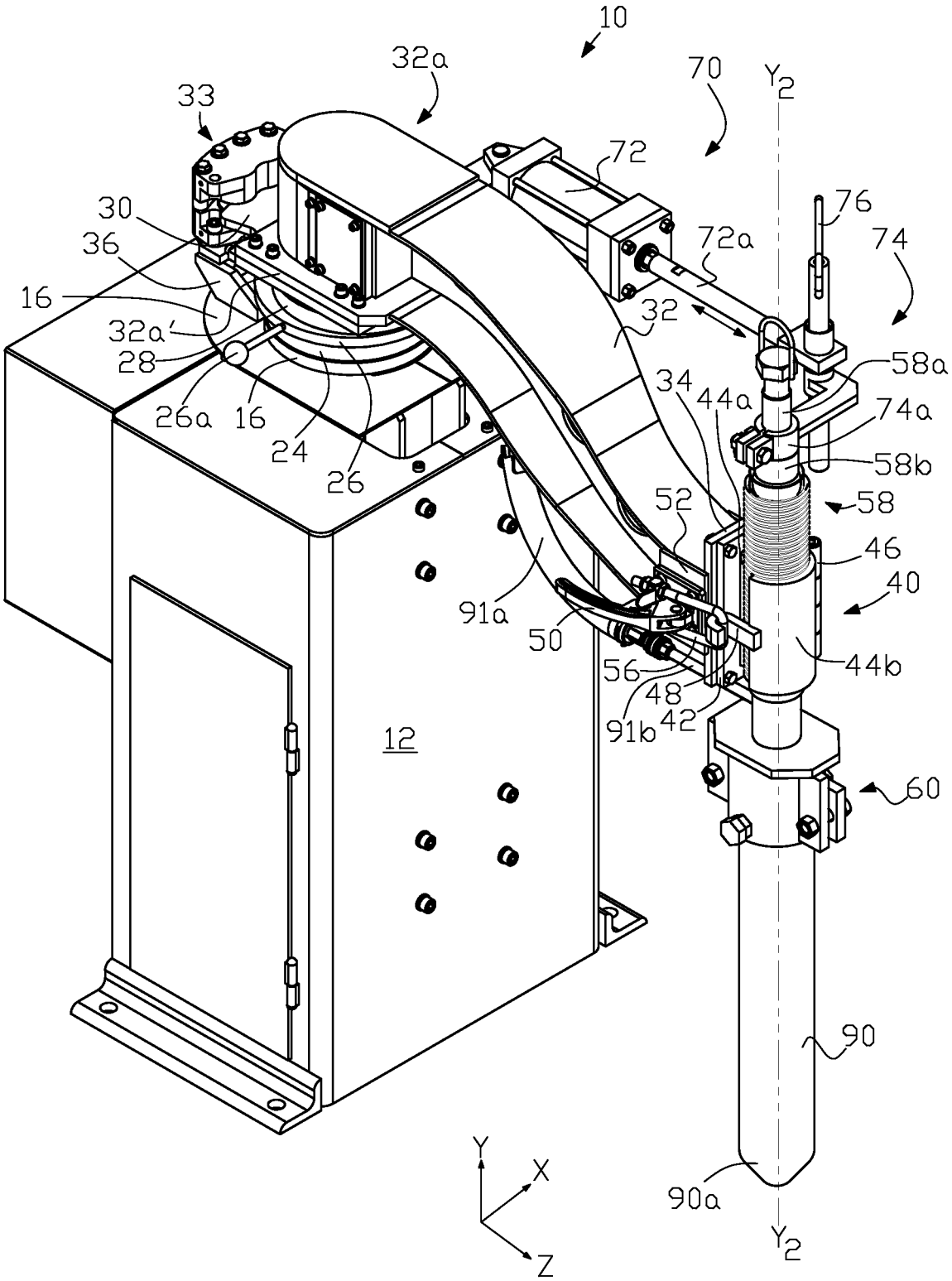
FIG. 1 is an isometric view of one example of a stopper rod positioning and control apparatus of the present invention.

Mounting plate 16 provides a suitable means for attachment of the outer race 24*a* of lower ring bearing 24 from below, and adjustment plate 26 provides a suitable means for attachment of the inner race 24*b* of the lower ring as best seen in detail in FIG. 9(*a*). Bracing lever 26*a* extends from the adjustment plate, for example, as shown in FIG. 1. Outer race 28*a* of upper ring bearing 28 is attached to adjustment plate 26 from below, and the inner race 28*b* of the upper ring bearing is attached to locking plate 30, which extends between brake pads 33*a* of caliper brake 33. Locking plate 30 is attached to first end 32*a* of extended arm 32 via a suitable structural element, such as structural plate 32*a*', and adaptor plate 34 is attached to the opposing second end 32*b* of the extended arm as shown, for example, in FIG. 9(*b*). Consequently the inner race 24*b* of lower ring bearing 24 and outer race 28*a* of upper ring bearing 28 rotate when adjustment plate 26 is rotated, and held in position when the adjustment plate is held in a fixed position, and the inner race 28*b* of upper ring bearing 28 and locking plate 30 rotate when extended arm 32 is rotated if the locking plate is not locked in position. Caliper brake assembly 33 is mounted on angle support 36, which extends from mounting plate 16 to position the caliper brake assembly off of the $Y_1$-$Y_1$ axis. A caliper brake is one example of a braking mechanism that may be used to hold the locking plate in position. Extended arm 32 is interconnected (between the ring bearings, adjustment plate and locking plate) to servomotor 18 via inner tube 22*a* of the lift apparatus so that the output of servomotor 18 controls the vertical (Y-direction) reciprocal movement of arm 32. Extended arm 32 is shown in the drawings in a preferred, but non-limiting configuration of a curved I-beam with a span in the Z-direction (horizontal) sufficiently long to span the horizontal distance between longitudinal axis $Y_1$-$Y_1$ and stopper rod 90, which is generally centered about longitudinal axis $Y_2$-$Y_2$. Downward curvature of the I-beam minimizes the vertical distance between the tip 90*a* of stopper rod 90 and the top of enclosure 12.

Figure 2:
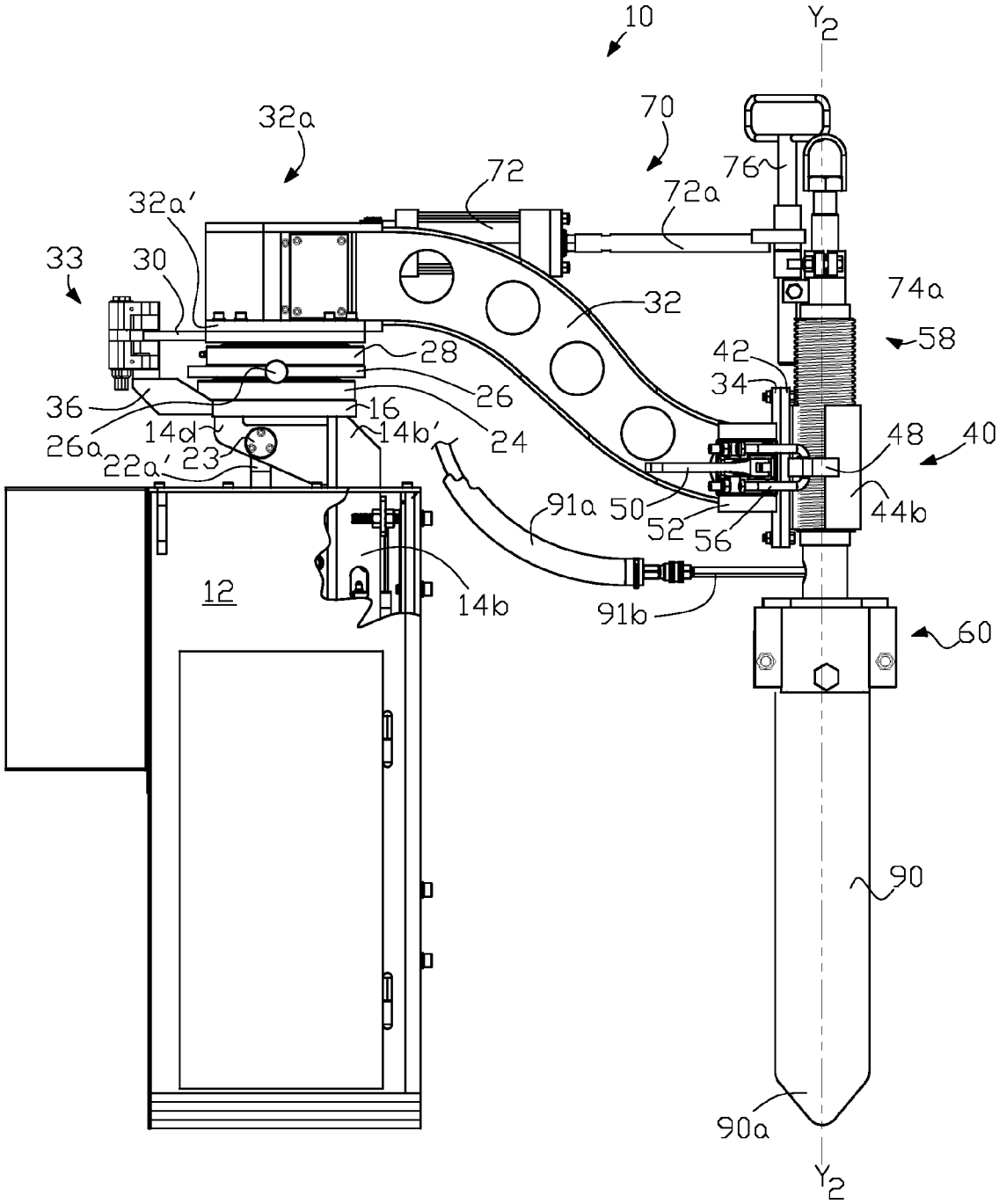
FIG. 2 is a side elevational view of the stopper rod positioning and control apparatus shown in FIG. 1.
Figure 3:
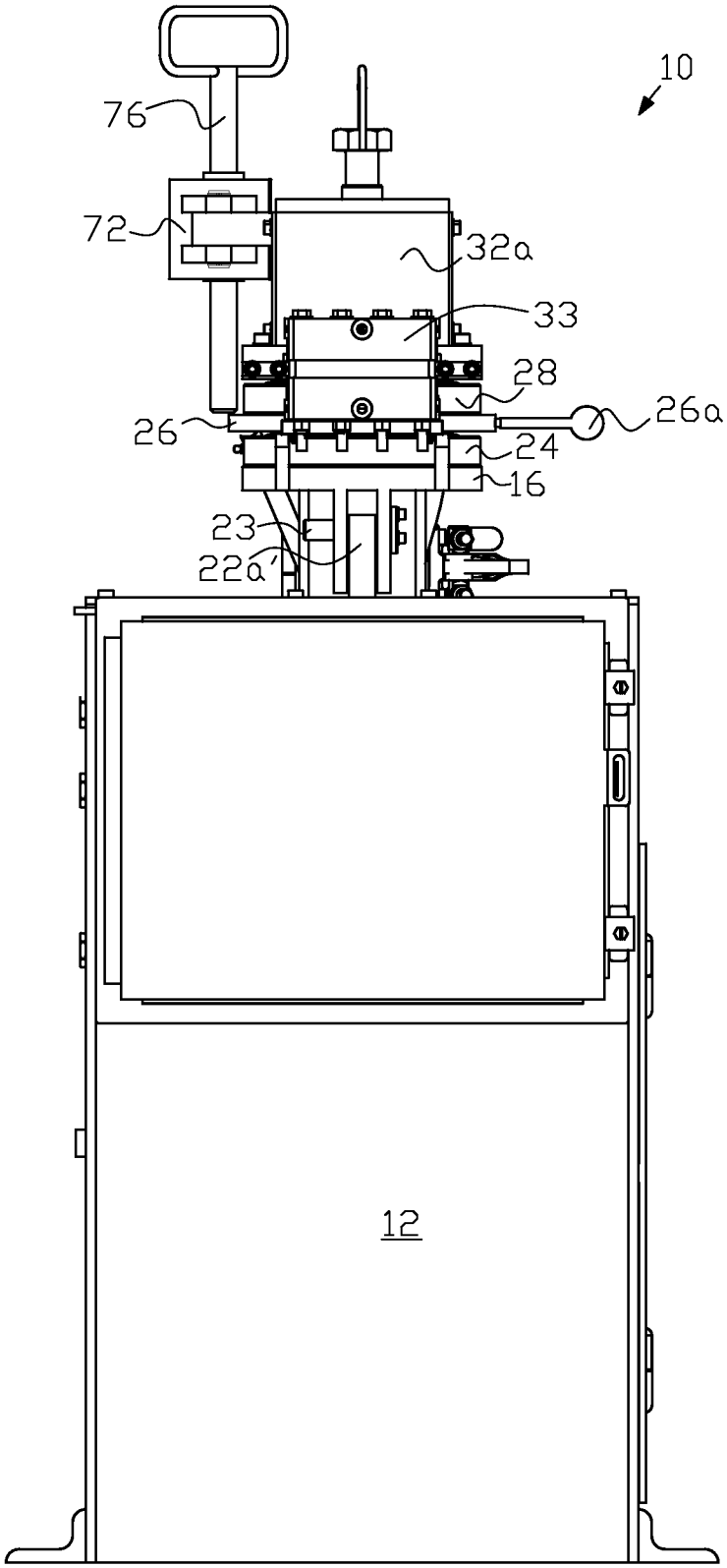
FIG. 3 is a rear elevational view of the stopper rod positioning and control apparatus shown in FIG. 1.
Figure 4:
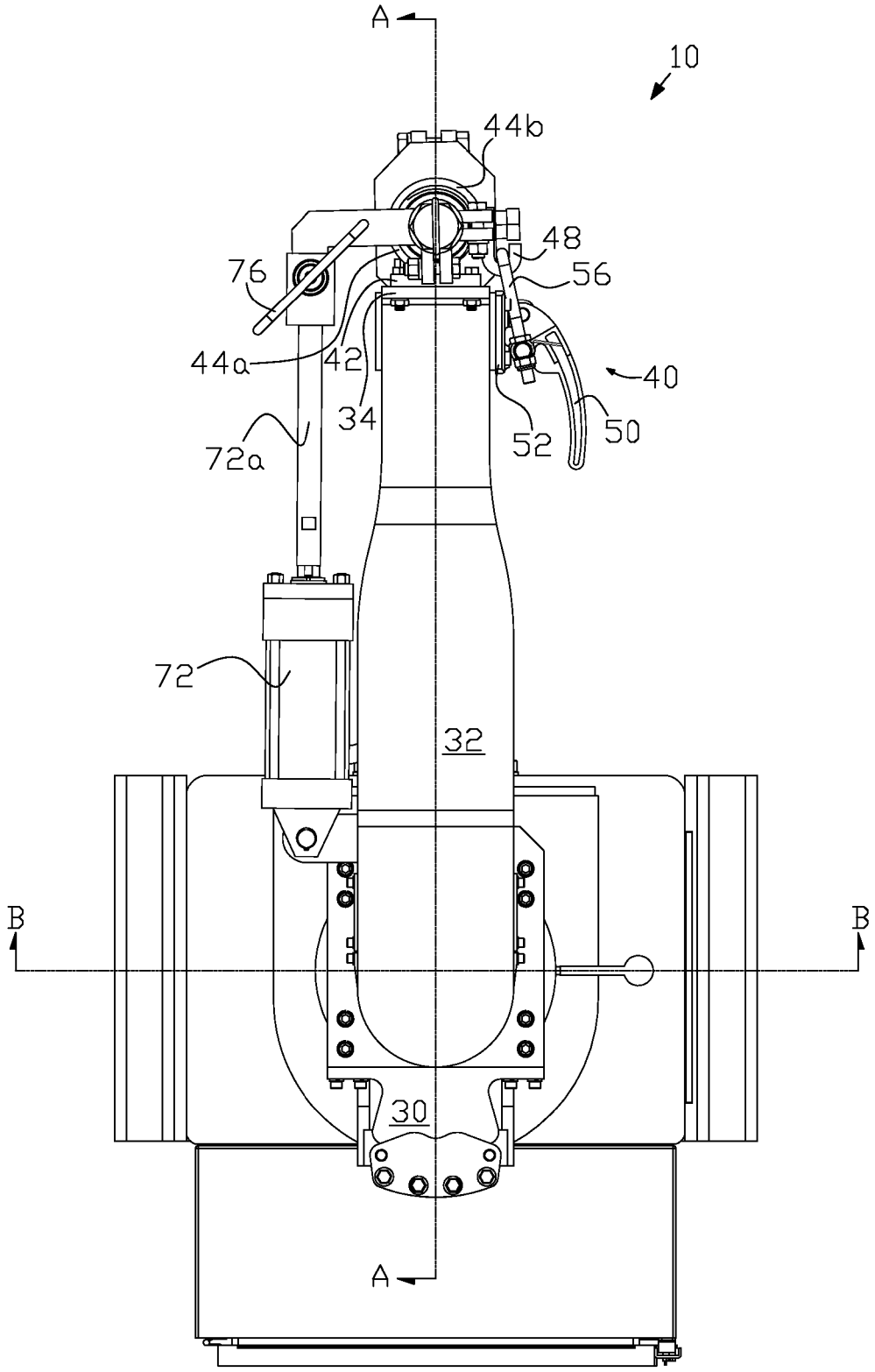
FIG. 4 is a top plan view of the stopper rod positioning and control apparatus shown in FIG. 1.

Stopper rod clamp assembly 40, as best seen in FIG. 1, FIG. 2 and FIG. 5(*a*), is suitably mounted to second end 32*b* of arm 32, for example, via plate 42, which is connected to plate 34 at the second end of the extended arm. Split sleeves 44*a* and 44*b* are joined together by hinge 46. One sleeve 44*a* is affixed to plate 42 while the other sleeve 44*b* is allowed to pivot on hinge 46. The pivotal sleeve 44*b* has a hook 48 attached thereto. Hook 48 is connected to a locking handle 50 via linkage 56. The locking handle is mounted on plate 52, which is fixed to arm 32. Thus, split sleeves 44*a* and 44*b* may be opened or locked closed thereby holding the threaded section of adaptor assembly 58. This allows stopper rod 90 that is attached to adaptor assembly 58 to be quickly changed. In some examples of the invention, the arcuate inside surfaces of split sleeves 44*a* and 44*b* are threaded to lock within the outer threaded region of adaptor assembly 58.

Stopper rod clamp assembly 40 releasably holds adaptor assembly 58. Replaceable stopper rod 90 is clamped to adaptor assembly 58, for example, via clamp ring 60. Stopper rod 90 is preferably cylindrical in shape and has a conical tip 90*a* which engages nozzle 82 as shown for example in FIG. 7(*a*). Protective bellows 62 may be provided around the opening in the top of enclosure 12 through which components of the servoactuator assembly extend. Stopper rod tip 90*a* may alternatively be hemispherical in shape, or other shape as required to seat in a particular nozzle opening. The stopper rod is formed from any suitable heat resistant material such as a graphite composition. The stopper rod may have an axially oriented internal through gas passage (not shown in the drawings) extending to the tip of the rod so that a neutralizing gas, such as nitrogen, can be fed from a suitable source via tubing 91*a* and 91*b* (as shown for example in FIG. 1 and FIG. 5(*a*)) through the gas passage and out of the tip 90*a* of the stopper rod when the stopper rod is seated in the nozzle to prevent solid oxidation buildup in the nozzle passage when exposed to air.

Servomotor 18 controls the vertical movement, both position and velocity, of stopper rod 90 along the $Y_2$-$Y_2$ axis. Servomotor 18 is preferably actuated by a controller, for example as disclosed in U.S. Pat. No. 4,744,407, which is incorporated herein by reference in its entirety. The controller monitors the level of molten metal in sprue cup 80*a* of mold 80 as shown for example in FIG. 7(*a*). The controller regulates the flow of material from nozzle 82 by actuating servomotor 18 to cause the vertical movement and positioning of stopper rod 90 above nozzle 82 along axis $Y_2$-$Y_2$. Servomotor 18 cooperates with the controller by providing the controller with information about the stopper rod's current position. Servomotor 18 can also be used to vary the seating force of the stopper rod 90 on nozzle 82 by varying the torque produced by the servomotor. Servomotor 18 can also be controlled manually or limit switches can be used to automatically control the stroke of stopper rod 90. As further shown in FIG. 7(*c*) through FIG. 7(*e*), in FIG. 7(*c*), tip 90*a* of stopper rod 90 is seated in nozzle 82 which is fitted in the bottom of refractory-lined molten metal reservoir 86. Upon command from the controller, the apparatus 10 raises stopper rod 90 from its seated position in nozzle 82 and molten metal 92 flows from the reservoir into mold 80 via sprue cup 80*a*. When the mold is filled with molten metal, apparatus 10 lowers stopper rod 90 to its seated position in nozzle 82 as shown in FIG. 7(*e*). Filled mold 80 is conveyed away from the reservoir while an empty mold is indexed underneath the nozzle for filling by repeating the process described above.

Nozzle stopper rod tip rotating assembly 70 (FIG. 1) can be provided as a means for reversibly rotating the tip 90*a* of stopper rod 90 when the tip is seated in a nozzle so that any buildup of metal in the seating area between stopper rod 90 and nozzle 82 can be cleared. Output shaft 72*a* of linear actuator 72 is attached to pivot assembly 74 which, in turn, is detachably connected, for example, by pin 76, to the stopper rod assembly 58. Reciprocal linear movement of output shaft 72*a* via the linear actuator in the directions of the double arrow line in FIG. 1 will result in a reversing rotational movement of the stopper rod tip around the $Y_2$-$Y_2$ axis. In this example of the invention clamp 74*a* of pivot assembly 74 is attached to inner tube 58*a*, which is installed within outer tube 58*b* Inner tube 58*a* is rotatable within outer tube 58*b* by means of bearings 59 as best seen in FIG. 5(*a*).

FIG. 7(*a*) illustrates one example of an application of apparatus 10 wherein stopper rod 90, which is clamped to adaptor assembly 58 of apparatus 10 via clamp ring 60, is used to control the flow of molten metal through the opening in single nozzle 82, which is disposed in the bottom of pouring launder 86. The pouring launder serves as a reservoir for molten metal supplied from one or more sources of molten metal such as a melting furnace or ladle. FIG. 7(*b*) illustrates another example of an application of apparatus 10 of the present invention wherein two stopper rod positioning and control apparatus 10 are used to control the flow of molten metal through the openings in two separate nozzles disposed in the bottom of double pour launder 86*a*. The two nozzles may comprise two discrete single nozzles, or a single dual nozzle block assembly 82*a*" as shown in FIG. 7(*b*). Further details of one non-limiting example of a dual nozzle assembly 82*a* used in the present invention is illustrated in FIG. 8(*a*) through FIG. 8(*d*). In FIG. 8(*a*), the overall dimensions of a particular dual nozzle assembly are selected based on the maximum spacing between sprue cups on the pair of molds into which molten metal is to be poured through the dual nozzle assembly. In FIG. 8(*a*) the maximum spacing between nozzle centers is defines as $x_1$ between nozzles 84*a* and 84*b* as cast, or otherwise formed, within the dual nozzle assembly. Subsequent to installation and use of dual nozzle assembly 82*a* as shown in FIG. 8(*a*), a requirement for closer spaced nozzles, such as nozzle pair 84*a*' and 84*b*' in FIG. 8(*b*) with a spacing of $x_2$ between nozzle centers can be cast, or otherwise formed in a dual nozzle assembly having the same overall dimensions of the dual nozzle assembly shown in FIG. 8(*a*) to accommodate a distance between sprue cup centers that is less than the maximum spacing.

Although a nozzle assembly is formed from heat resistant materials, the nozzle assembly will wear over a period of use with exposure to the flow of molten metals and have to be replaced. Typically replacement is accomplished without allowing the launder (or other bottom pour vessel) structure surrounding the nozzle assembly to cool down, and therefore it is preferable to accomplish nozzle assembly replacement as quickly and efficiently as possible. In a double pour application, the single dual nozzle assembly, such as dual nozzle assembly 82*a* in FIG. 8(*a*) accomplishes this requirement. Further a single dual nozzle assembly of the present invention allows the distance between the openings of each nozzle in the dual nozzle assembly to be changed when the replacement dual nozzle assembly is originally cast or otherwise formed. For example as shown in FIG. 8(*b*) the distance $x_1$ between centers of nozzle openings for nozzle pair 84*a* and 84*b* (shown in solid lines) as cast in a first dual nozzle assembly, can be changed to distance $x_2$ between centers of nozzle openings for nozzle pair 84*a*' and 84*b*' (shown in dashed lines) as cast in a second dual nozzle assembly having the same overall dimensions as the first dual nozzle assembly. Thus a significant change in the distance between and relative positions of each nozzle in a single dual nozzle assembly having the same overall dimensions can be achieved. Comparatively if two single replacement nozzle assemblies are used, the distance between centers of the nozzle openings must be accomplished during the actual fitting of the two single replacement nozzle assemblies in the bottom of a hot launder or other reservoir of molten metal. The ability to change the length between centers of the two separate nozzle openings is related to the length (or location) between sprue cups 80*a* in adjacent molds in a dual pour automated mold line as shown for example in FIG. 7(*b*). That is in a dual pour process utilizing a single molten metal containment vessel, if the relative locations of sprue cups in adjacent molds in an automated line of molds changes, then the relative locations of the dual nozzles will also need to be changed by changing out the nozzle assemblies. Further regardless of whether two separate single nozzle assemblies or a single dual nozzle assembly is used, the stopper rod positioning features of the stopper rod positioning and control apparatus 10 of the present invention can be used to quickly adjust the stopper rod position of each apparatus to changes in positions of the nozzles.

Figure 10B:
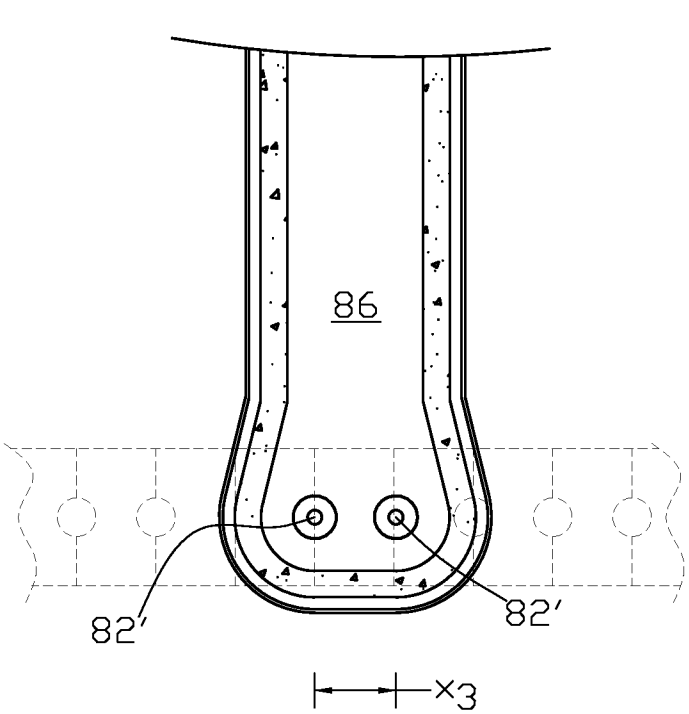
FIG. 10(*a*), FIG. 10(*b*) and FIG. 10(*c*) illustrate one example of the stopper rod positioning and control apparatus of the present invention with a dual nozzle bottom pour launder where the dual nozzles are separately installed in the launder.
Figure 10A:
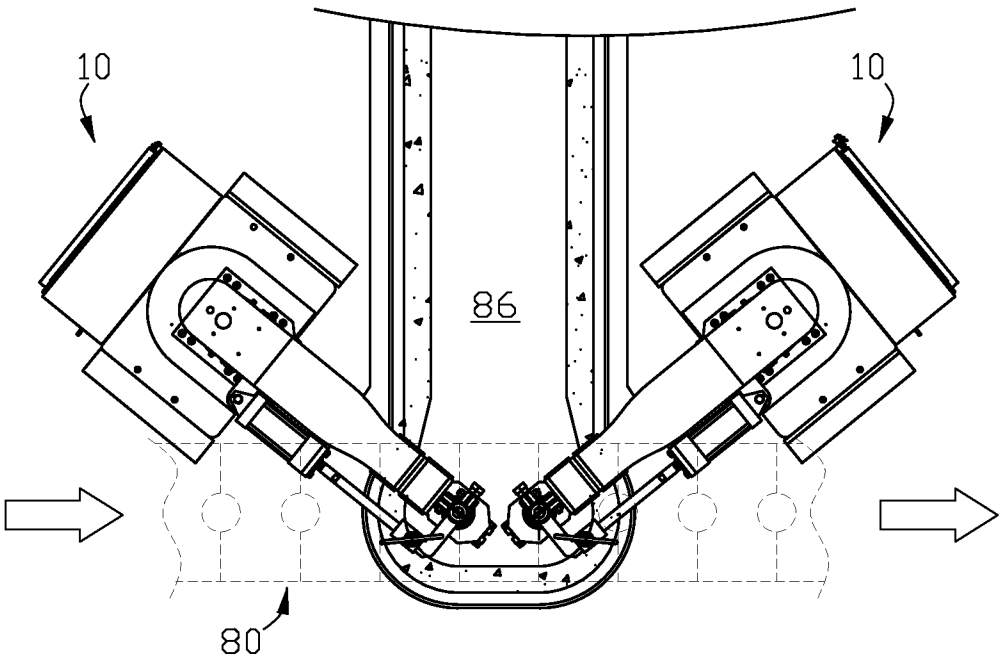
Figure 10C:
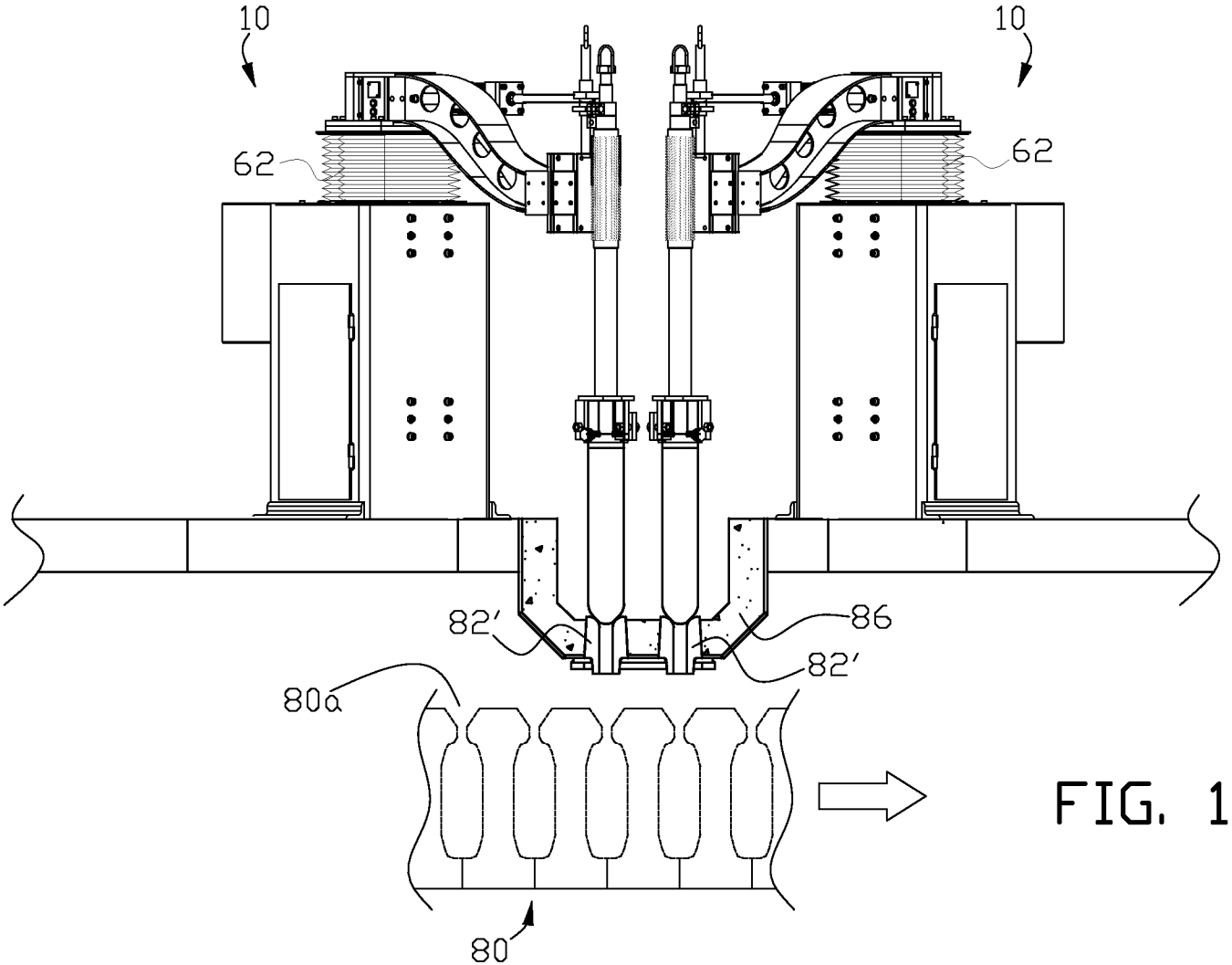
Figure 11B:
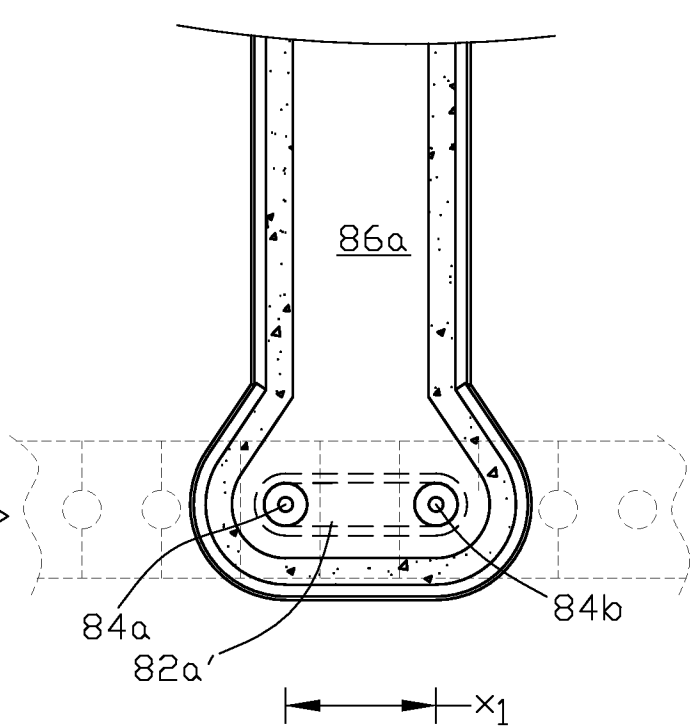
FIG. 11(*a*), FIG. 11(*b*) and FIG. 11(*c*) illustrate another example of the stopper rod positioning and control apparatus of the present invention with a dual nozzle bottom pour launder where the dual nozzles are contained within a common dual nozzle block installed in the launder.
Figure 11A:
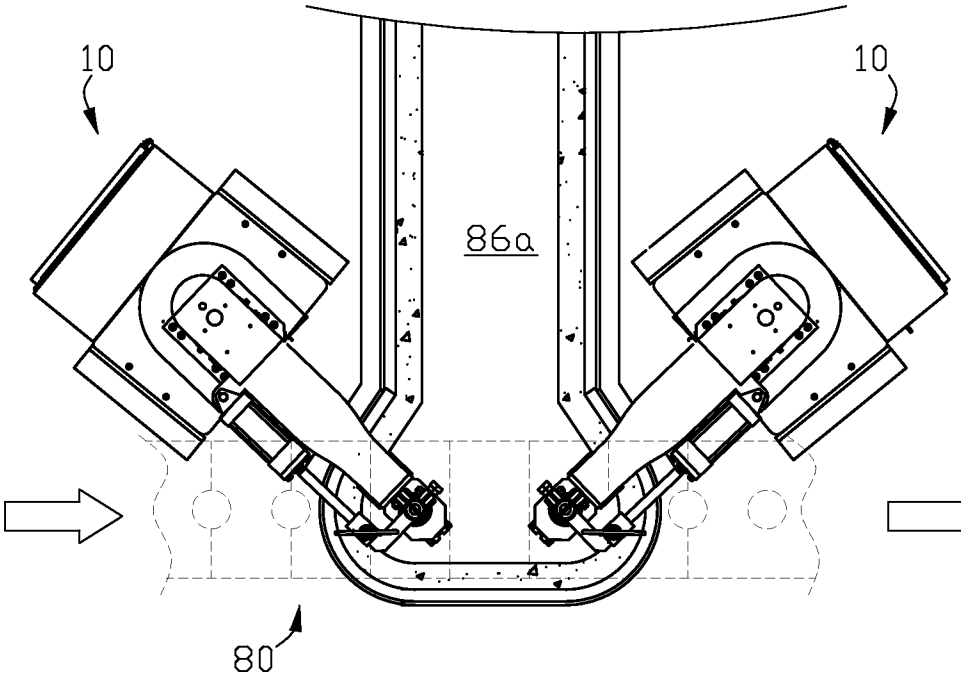
Figure 11C:
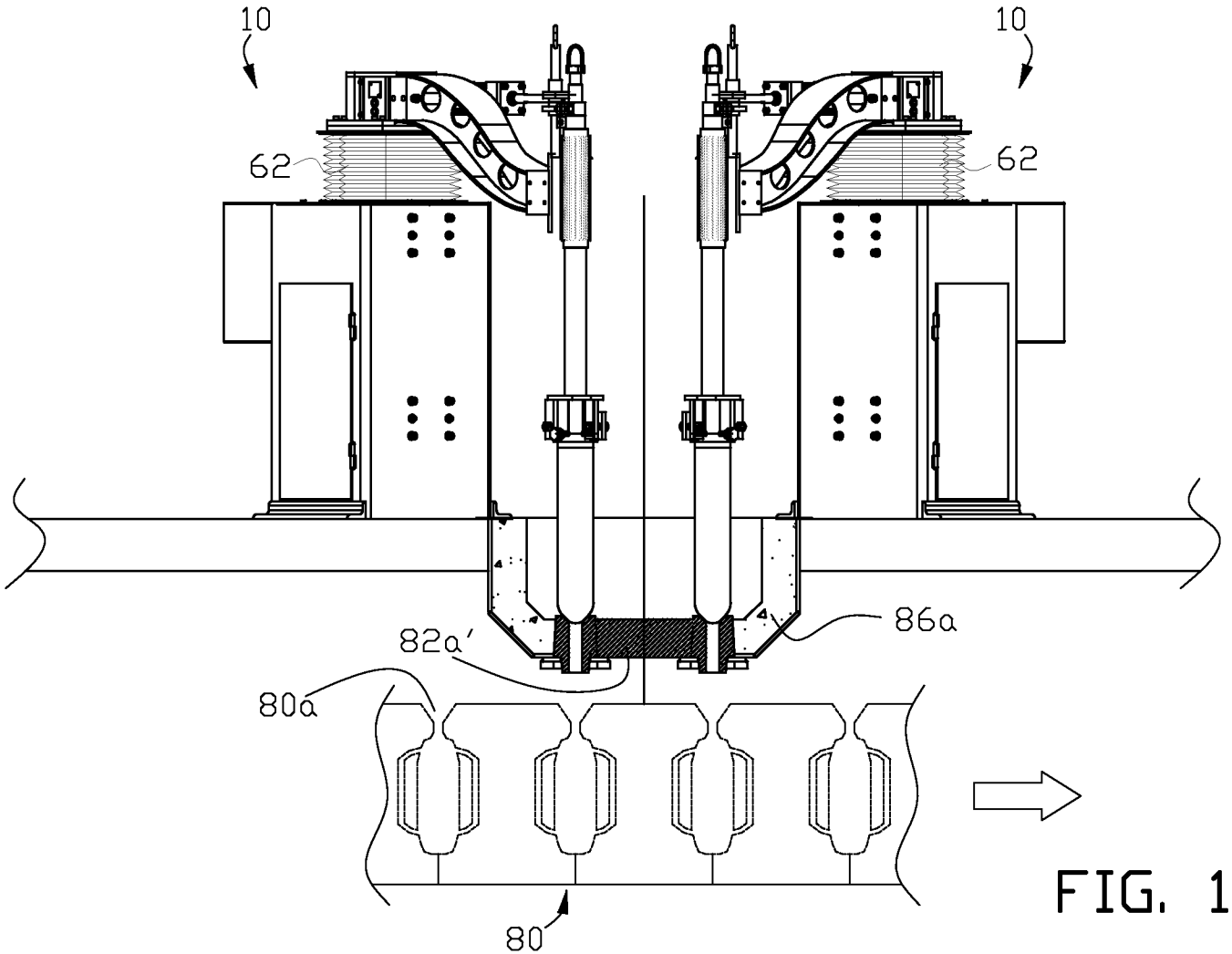
Figure 12B:
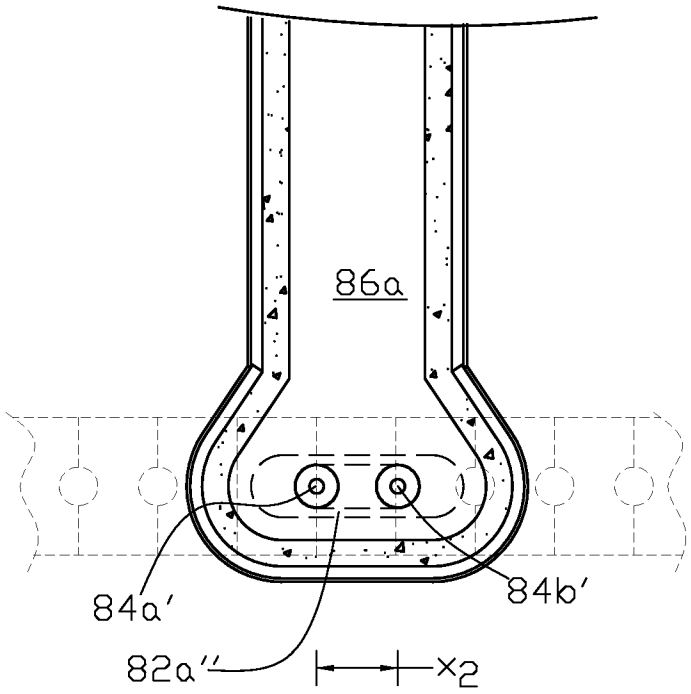
FIG. 12(*a*), FIG. 12(*b*) and FIG. 12(*c*) illustrate another example of the stopper rod positioning and control apparatus of the present invention with a dual nozzle bottom pour launder where the dual nozzles are contained within a common dual nozzle block installed in the launder.
Figure 12A:
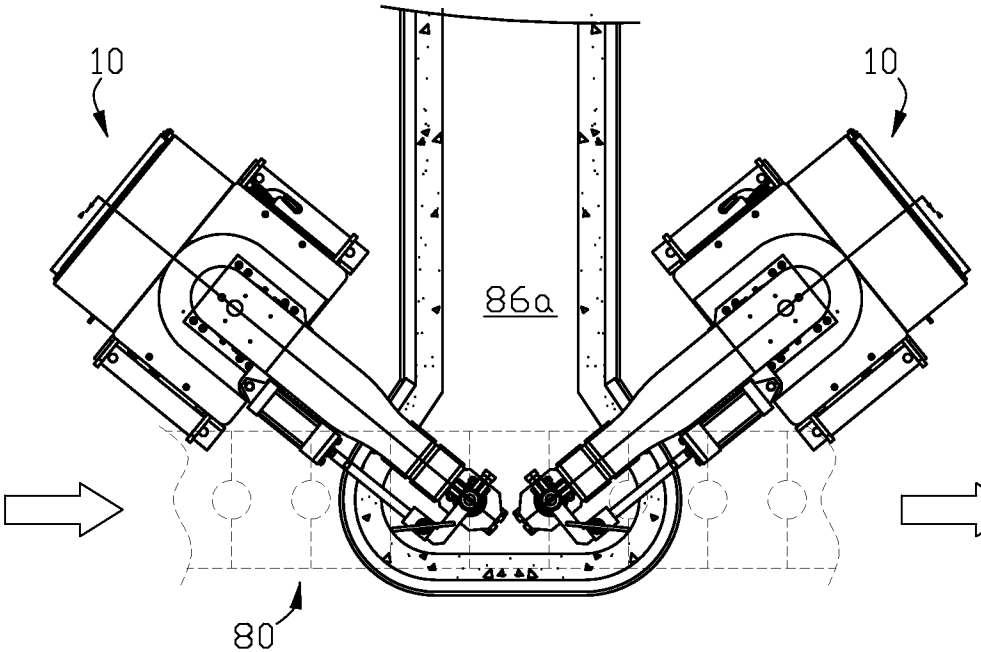
Figure 12C:
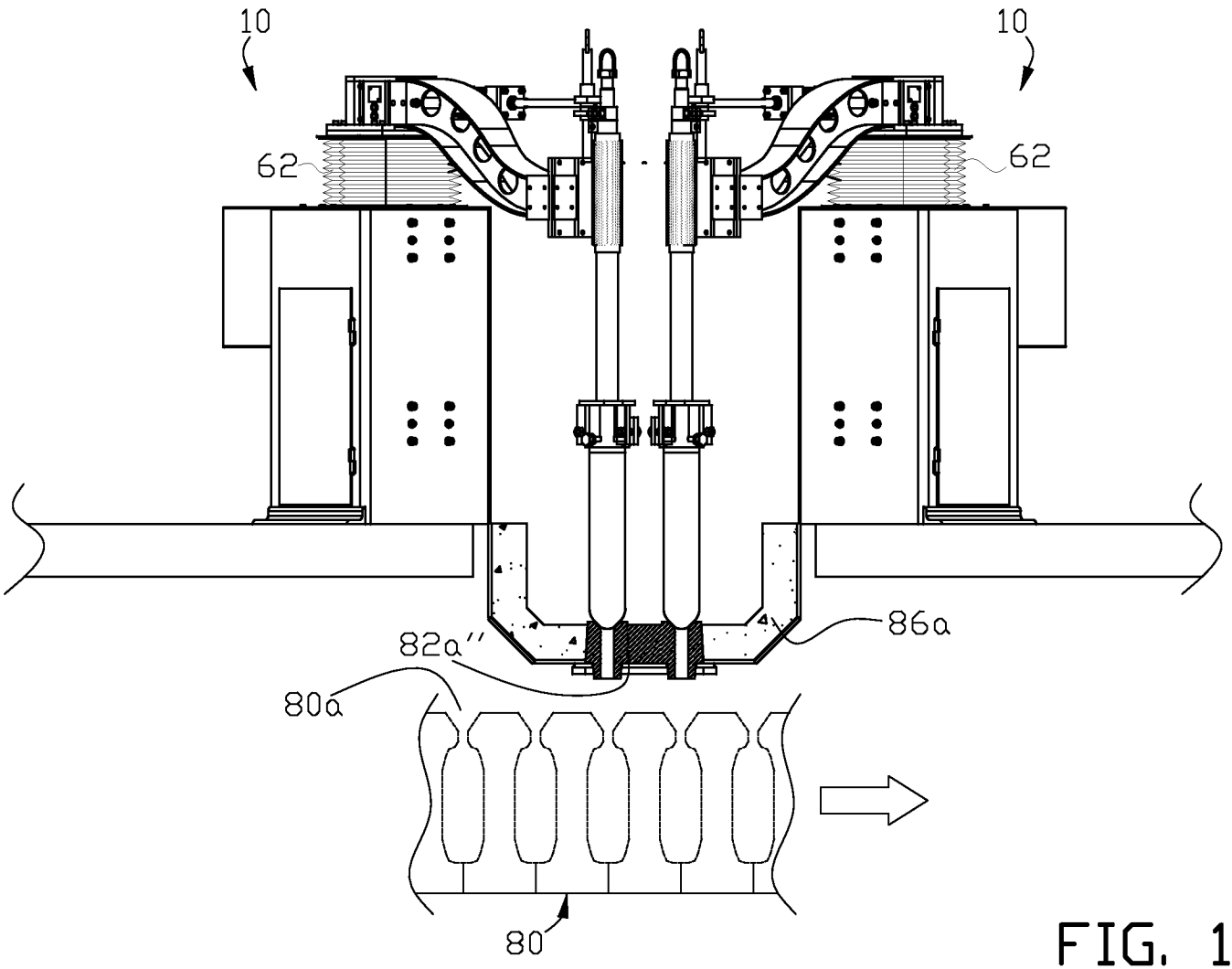

The advantage of a single dual nozzle block is illustrated by two examples of the invention shown in FIG. 11(*a*), FIG. 11(*b*) and FIG. 11(*c*) for the first example, and FIG. 12(*a*), FIG. 12(*b*) and FIG. 12(*c*) for the second example. Both examples utilize the same refractory-lined launder 86*a* and two stopper rod positioning and control apparatus 10 of the present invention. For the first example single dual nozzle block 82*a*' contains separate nozzles 84*a* and 84*b* as shown in FIG. 11(*b*) and FIG. 11(*c*) that are spaced apart from each other by distance $x_1$. For the second example single dual nozzle block 82*a*", which has substantially the same overall dimensions as dual nozzle block 82*a*', contains separate nozzles 84*a*' and 84*b*' as shown in FIG. 12(*b*) and FIG. 12(*c*) that are spaced apart from each other by distance $x_2$, which distance is less than the distance $x_1$. With this dual nozzle block arrangement different spacing between sprue cups 80*a* in molds 80 can be accommodated with the same launder by change out of a common dual nozzle block with the same overall dimensions, which can accommodate a range of different distances between the two nozzles within the block. The launder may have a slotted bottom that accommodates the fixed overall dimensions of the common dual nozzle block. The arrangement in these first and second examples with a common dual nozzle block is contrasted with the arrangement in a third example as shown in FIG. 10(*a*), FIG. 10(*b*) and FIG. 10(*c*). In this third example two separate single nozzles 82' are utilized in launder 86. In this example when different distances between the two individual nozzles is required launder 86 would be replaced with another launder having the two individual nozzles spaced apart as required to accommodate sprue cup spacing in adjacent molds.

Figure 13B:
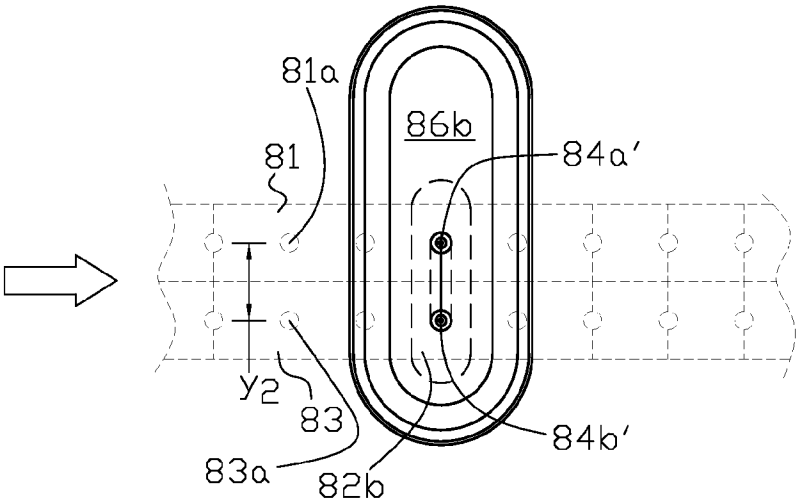
FIG. 13(*a*) and FIG. 13(*b*) illustrate another example of the stopper rod positioning and control apparatus of the present invention with a dual nozzle bottom pour launder where the dual nozzles are contained within a common dual nozzle block installed in the launder.
Figure 13A:
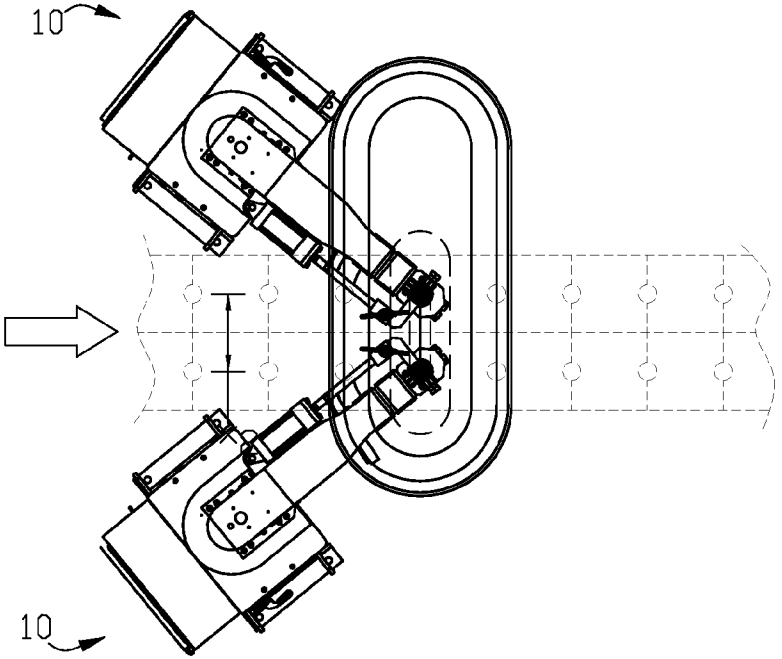

Some of the above examples of the invention illustrate use of two stopper rod positioning and control apparatus 10 when the two molds being filled are oriented in a single series mold line as shown, for example, in FIG. 10(*a*) through FIG. 12(*c*). In other examples of the invention two stopper rod positioning and control apparatus 10 of the present invention are used when the two molds (for example, molds 81 and 83) being filled are oriented in a double series (or parallel) mold line configuration as shown in FIG. 13(*a*) and FIG. 13(*b*). Single dual nozzle block 82*b* contains separate nozzles 84*a*' and 84*b*' as shown in FIG. 13(*b*) that are spaced apart from each other by distance $y_2$. With this dual nozzle block arrangement different spacing between sprue cups 81*a* and 83*a* (in the indicated y-direction) in parallel oriented molds 81 and 83 can be accommodated with the same launder by change out of the dual nozzle block, which can accommodate a range of different distances between the two nozzles within the block. The launder may have a slotted bottom that accommodates the overall dimensions of the common dual nozzle block.

Figure 6:
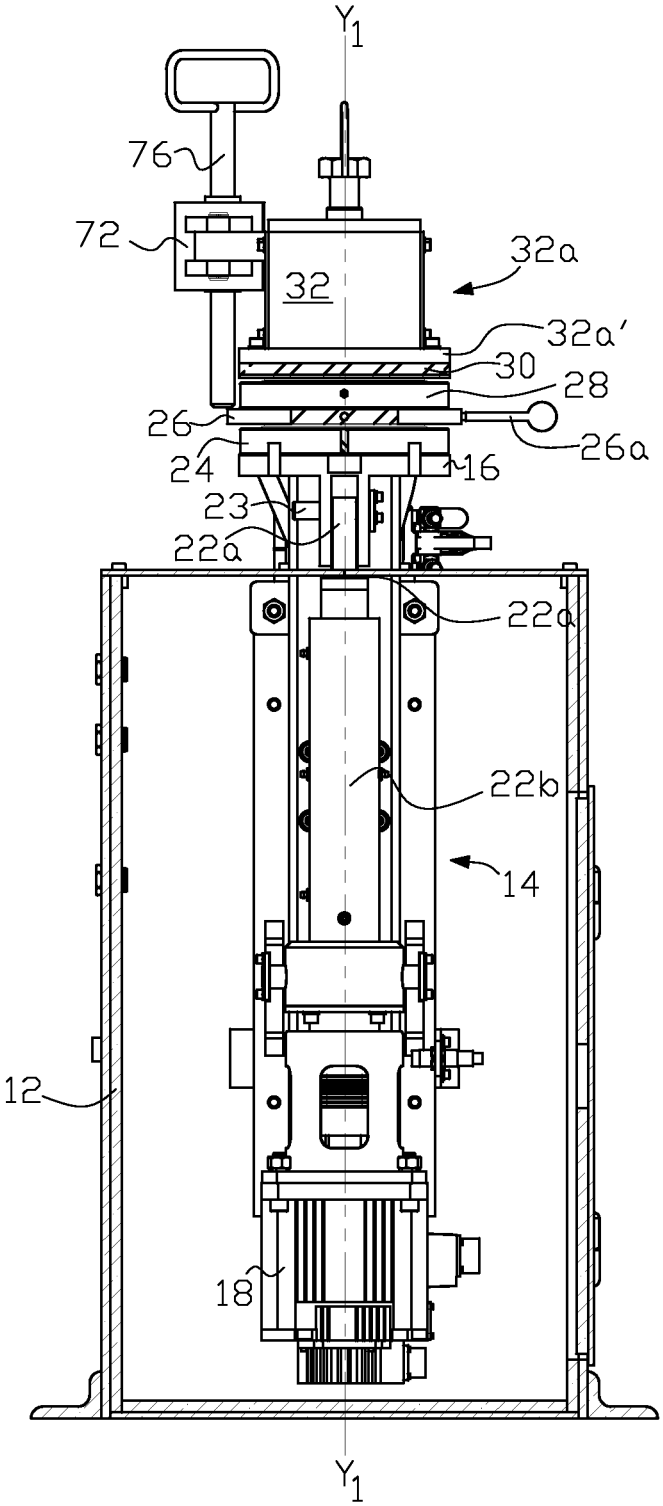
FIG. 6 is a cross sectional elevation view of the stopper rod positioning and control mechanism shown in FIG. 1 through line B-B in FIG. 4.
Figure 7A:
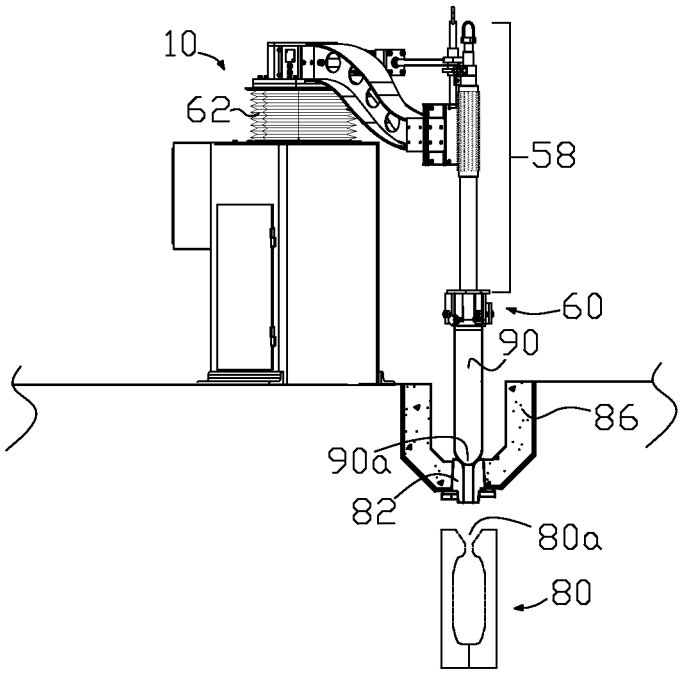
FIG. 7(*a*) is a partial elevational view of a stopper rod positioning and control apparatus of the present invention with a stopper rod clamped to the apparatus and a launder with a single bottom pour nozzle.
Figure 7B:
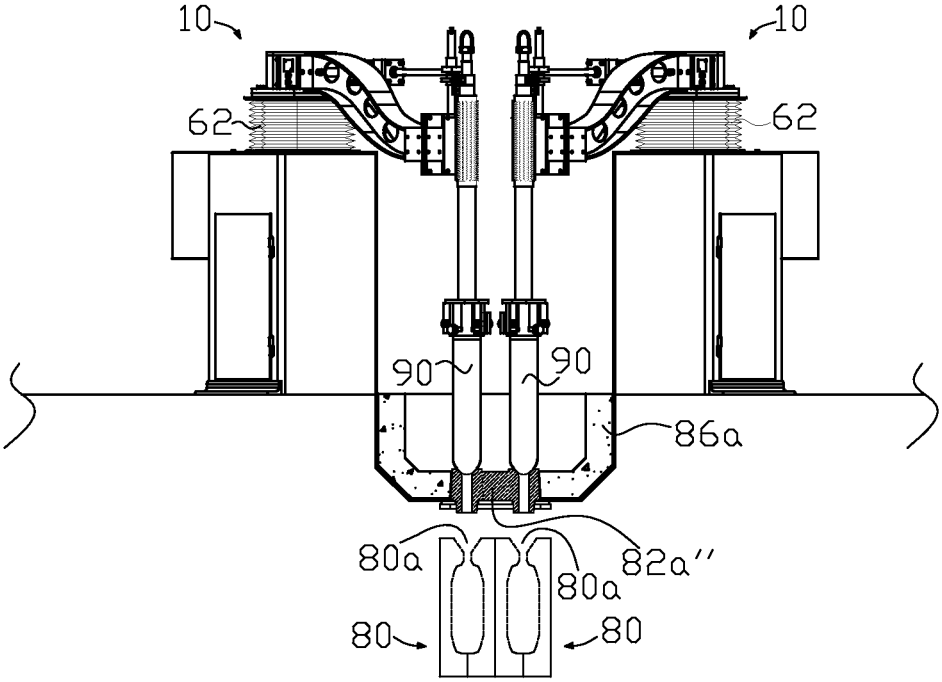
Figure 7C:
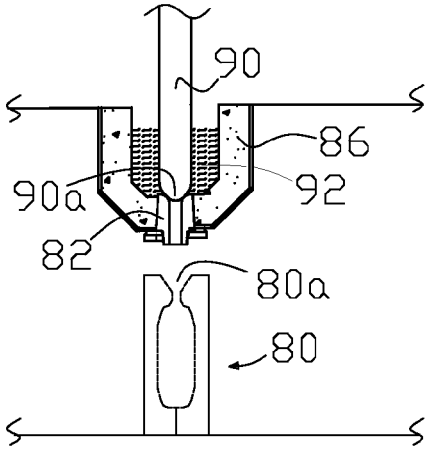
Figure 7D:
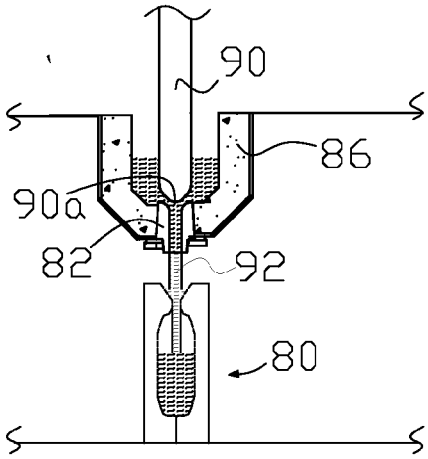
Figure 7E:
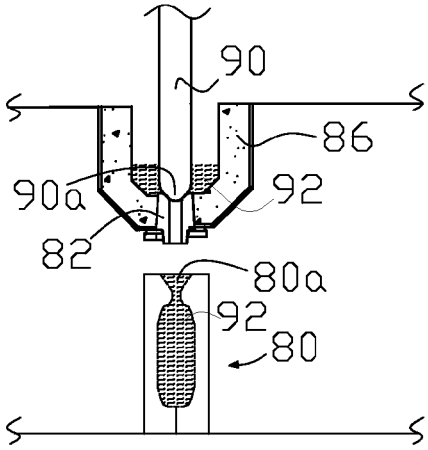
Figures 9A, 9B, 9C:
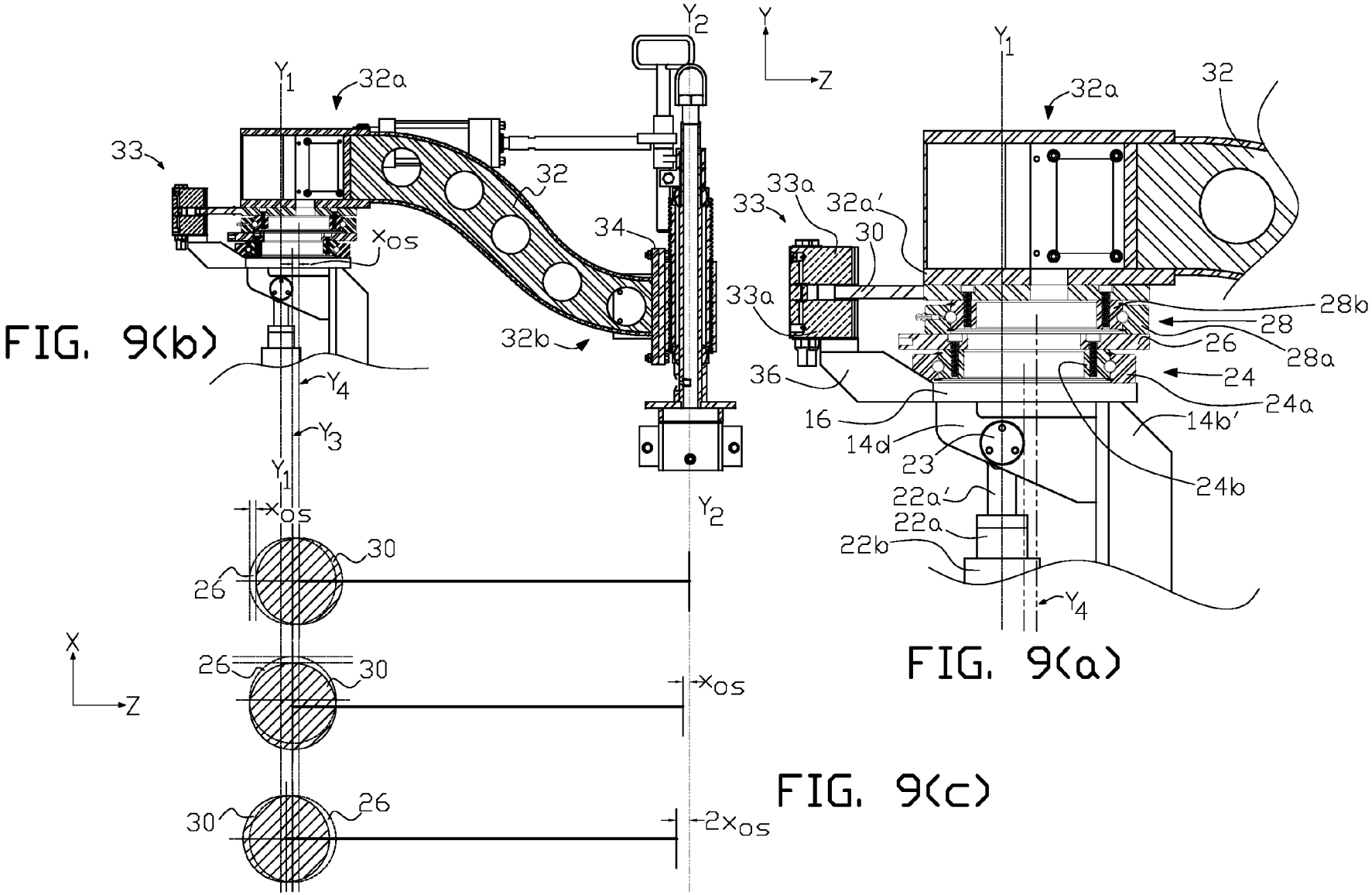
FIG. 9(*a*) and FIG. 9(*b*) are partial details of the servoactuator assembly with components used to align a stopper rod with a nozzle in a bottom pour vessel.

One feature of apparatus 10 of the present invention is stopper rod alignment components as best seen in FIG. 9(*a*) and FIG. 9(*b*). Outer race 24*a* of lower ring bearing 24 is attached to mounting plate 16, and the inner race 24*b* of the lower ring bearing is attached to adjustment plate 26, which has attached to it bracing lever 26*a* (FIG. 6). Outer race 28*a* of upper ring bearing 28 is attached to adjustment plate 26, and the inner race 28*b* of the upper ring bearing is attached to locking plate 30. Locking plate 30 is attached to first end 32*a* of extended arm 32 at structural element 32*a*'. The inner race of the lower ring bearing is centered and rotatable about axis $Y_3$, while the inner race of upper ring bearing is rotatable about axis $Y_4$. Axis $Y_4$ is horizontally offset from axis $Y_3$ by distance $x_{os}$. Consequently depending upon the relative positions of the upper and lower ring bearings, location of the axial center of a stopper rod along axis $Y_2$ can be adjusted to a position within a circle on the Z-X plane that has a diameter equal to two times the distance $x_{os}$ as geometrically illustrated in FIG. 9(*c*). Once a desired position is achieved, locking plate 30 can be locked in position by caliper brake assembly 33, with brake pads 33*a* of the brake assembly clamped against opposing sides of the plate. Caliper brake assembly 33 may be pneumatically operated with the clamped position being the failsafe position. For the process of adjusting the position of a stopper rod an operator would center the stopper rod over the opening in a nozzle by manually rotating extended arm 32 while rotating adjustment plate 26 via bracing level 26*a*. When the desired centered position is achieved, brake assembly 33 engages locking plate 30 to hold the achieved centered position. For example if brake assembly comprises a caliper brake, brake pads 33*a* would be forced against the opposing sides of locking plate 30.

Figure 14:
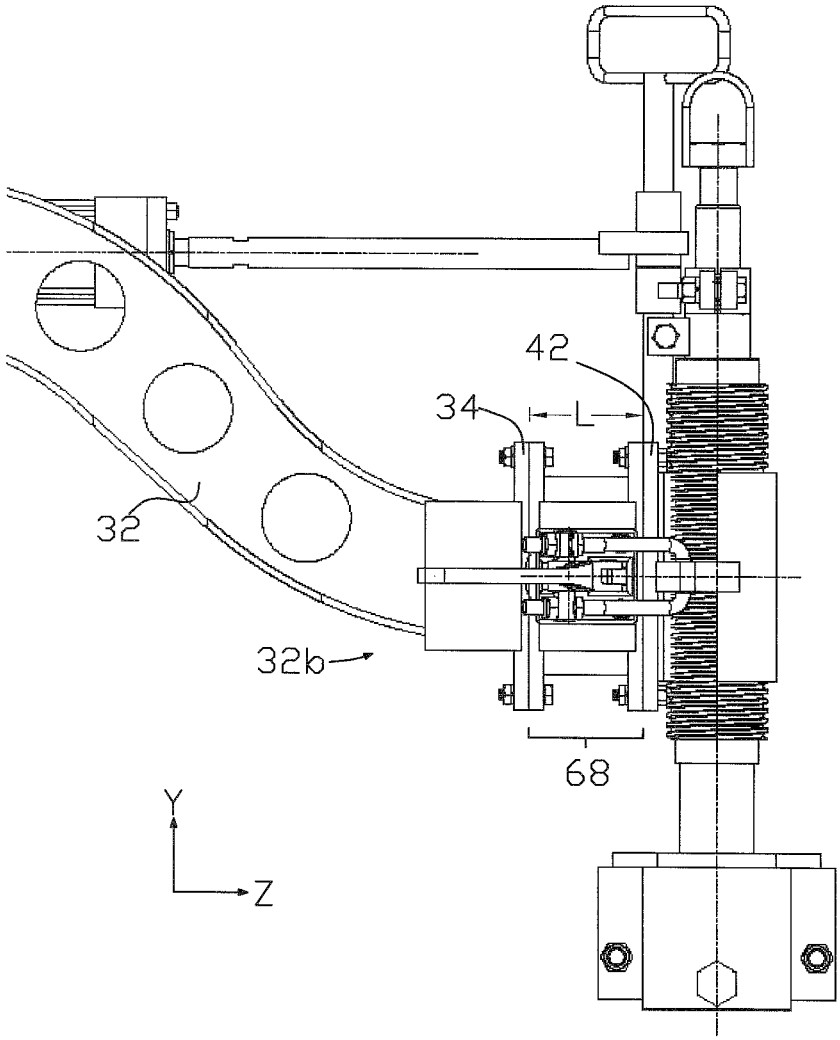
FIG. 14 is a detail of one example of an extended arm adjustment fixture that can be used as a further adjusting means for centering a stopper rod with a nozzle in a bottom pour reservoir of molten metal.

While the above stopper rod positioning apparatus and method provide for adjustment of the stopper rod and associated tip in a circular region defined in the Z-X plane, a second means of adjustment in the location of the stopper rod and associated tip may be accomplished by utilizing a spacer element 68 as shown in FIG. 14. Linear spacer element 68 is connected between arm second end plate 34 and plate 42 thereby extending the horizontal distance between vertically oriented axis $Y_1$-$Y_1$ and $Y_2$-$Y_2$ for a distance equal to the length, L, (in the Z-direction) of the spacer element, which may be, for example, in the shape of a box structure. One application of the arm extension or spacer element 68 is when a single launder is used with a dual nozzle block where the distance between the two nozzles in the nozzle block changes depending upon the spacing of the mold sprue cups in the mold line. For example a spacer element may be used with the two apparatus 10 shown in FIG. 12(*a*) when the two nozzles are more closely spaced together than, for example, as shown in FIG. 11(*a*). The extension arm may also be used in separate dual nozzle applications when the launder is changed to accommodate different distances between nozzles.

A third means of adjustment in location of the stopper rod and associated tip may be accomplished by positioning the lift apparatus relative to an X-Y table, as known in the art, which would permit adjustment of the position of the lift apparatus in the horizontal plane (defined as the X-Z plane in the drawings). For example if enclosure 12 is used to contain the servoactuator assembly (including the lift apparatus), the bottom of the enclosure may be mounted on a suitable X-Y table to move the entire enclosure, including the enclosed servoactuator assembly. With this arrangement the position of the longitudinal axis $Y_1$-$Y_1$, which is substantially perpendicular to the horizontal plane can be changed and consequently the position of the axis $Y_2$-$Y_2$ about which the stopper rod is also centered will also change relative to the horizontal plane.

In a particular application of the stopper rod positioning and control apparatus of the present invention, either one, or a combination of two or three of the disclosed means of adjustment in location of the stopper rod and associated tip relative to the opening in a nozzle may be used.

While a dual nozzle application is described in some examples of the invention, more than two nozzles may be accommodated in other examples of the invention.

The above examples of the invention have been provided merely for the purpose of explanation and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification, may effect numerous modifications thereto, and changes may be made without departing from the scope of the invention in its aspects.

The invention claimed is:

1. A method of aligning a stopper rod attached to a positioning and control apparatus with a nozzle disposed in the bottom of a molten metal holding reservoir where the positioning and control apparatus comprises: a lift apparatus centered on a substantially vertically oriented longitudinal axis, the lift apparatus having an inner tube telescopically mounted within an outer tube, the inner tube being reciprocally movable along the substantially vertically oriented longitudinal axis; a servomotor fixedly mounted at a lower end of the outer tube, the servomotor having a servomotor output interconnected to the inner tube whereby actuation of the servomotor results in reciprocal movement of the inner tube along the substantially vertically oriented longitudinal axis; a lower ring bearing having a lower ring bearing outer race and a lower ring bearing inner race, a vertically oriented central axis of the lower ring bearing offset from the substantially vertically oriented longitudinal axis, the lower ring bearing outer race fastened to a telescoping end of the inner tube by a lower ring bearing outer race mounting plate fastened to a slide angle plate to reciprocally move the lower ring bearing along the substantially vertically oriented longitudinal axis with the inner tube; an upper ring bearing having an upper ring bearing outer race and an upper ring bearing inner race, a vertically oriented central axis of the upper ring bearing offset from the substantially vertically oriented longitudinal axis and the vertically oriented central axis of the lower ring bearing; an adjustment plate respectively attached on opposing sides to the lower ring bearing inner race and the upper ring bearing outer race to rotate the upper ring bearing outer race with the lower ring bearing inner race; a locking plate attached to the upper ring bearing inner race to rotate the locking plate with the upper ring bearing inner race about the vertically oriented central axis of the upper ring bearing; a brake assembly having a means for locking the locking plate in a locked position to inhibit rotation of the locking plate; and an arm having a first arm end and a second arm end, the first arm end attached to the locking plate to rotate the arm about the vertically oriented central axis of the upper ring bearing, the second arm end extending at least in the horizontal direction away from the substantially vertically oriented longitudinal axis, the stopper rod depending from the second end of the arm, the method comprising the steps of simultaneously rotating the adjustment plate and rotating the arm until the stopper rod is centered in a plane over the opening in the nozzle, and locking the locking plate in the locked position when the stopper rod is centered in the plane over the opening in the nozzle.

2. The method of claim 1 further comprising the step of providing a linear extension element between the second arm end and the stopper rod to center the stopper rod in the plane over the opening in the nozzle.

3. The method of claim 1 further comprising the steps of positioning the lift apparatus relative to an X-Y table with the substantially vertically oriented longitudinal axis perpendicular to the horizontal motion planes of the X-Y table so that adjustment of the X-Y table moves the substantially vertically oriented longitudinal axis in a horizontal plane to center the stopper rod in the plane over the opening in the nozzle.

4. A stopper rod positioning and control apparatus for control of molten metal flow through a nozzle disposed in a bottom of a molten metal holding reservoir, the stopper rod positioning and control apparatus comprising:

a lift apparatus centered on a substantially vertically oriented longitudinal axis, the lift apparatus having an inner tube telescopically mounted within an outer tube, the inner tube being reciprocally movable along the substantially vertically oriented longitudinal axis;

a servomotor fixedly mounted at a lower end of the outer tube, the servomotor having a servomotor output interconnected to the inner tube whereby actuation of the servomotor results in reciprocal movement of the inner tube along the substantially vertically oriented longitudinal axis;

a lower ring bearing having a lower ring bearing outer race and a lower ring bearing inner race, a vertically oriented central axis of the lower ring bearing offset from the substantially vertically oriented longitudinal axis, the lower ring bearing outer race fastened to a telescoping end of the inner tube by a lower ring bearing outer race mounting plate fastened to a slide angle plate connected to the telescoping end to reciprocally move the lower ring bearing along the substantially vertically oriented longitudinal axis with the inner tube;

an upper ring bearing having an upper ring bearing outer race and an upper ring bearing inner race, a vertically oriented central axis of the upper ring bearing offset from the substantially vertically oriented longitudinal axis and the vertically oriented central axis of the lower ring bearing, the upper ring bearing outer race attached to the lower ring bearing inner race by an adjustment plate to rotate the upper ring bearing outer race with the lower ring bearing inner race;

a locking plate attached to the upper ring bearing inner race to rotate the locking plate with the upper ring bearing inner race about the vertically oriented central axis of the upper ring bearing;

a brake assembly having a means for locking the locking plate in a locked position to prevent rotation of the locking plate;

an arm having a first arm end and a second arm end, the first arm end attached to the locking plate to rotate the arm about the vertically oriented central axis of the upper ring bearing, the second arm end extending at least in the horizontal direction away from the substantially vertically oriented longitudinal axis; and a stopper rod depending from the second end of the arm;

whereby the stopper rod is centered in a plane over the nozzle by the combined movements of rotating the lower ring bearing inner race about the vertically oriented central axis of the lower ring bearing and rotating the upper ring bearing inner race about the vertically oriented central axis of the upper ring bearing to an aligned stopper rod position centered in the plane over the nozzle, then locking the aligned stopper rod position by the means for locking the locking plate in the locked position, and thereafter reciprocally moving the stopper rod above the nozzle by actuation of the servomotor.

5. The stopper rod positioning and control apparatus of claim 4 further comprising a linear guide assembly comprising a stationary base and a sliding element, the slide angle plate extending from an upper end of the sliding element and passing through the substantially vertically oriented longitudinal axis, the stationary base supporting the weight of the servomotor and lift apparatus.

6. The stopper rod positioning and control apparatus of claim 4 further comprising an interior passage in the stopper rod for supply of a neutralizing gas to the tip of the stopper rod when the stopper rod is seated in the nozzle.

7. The stopper rod positioning and control apparatus of claim 4 further comprising a means for reversibly rotating the tip of the stopper rod when the tip is seated in the nozzle.

8. A stopper rod positioning and control apparatus for control of molten metal flow through a nozzle disposed in the bottom of a molten metal holding reservoir, the stopper rod positioning and control apparatus comprising:

an outer tube having a substantially vertically oriented longitudinal axis;

an inner tube telescopically mounted within the outer tube, the inner tube being reciprocally movable along the substantially vertically oriented longitudinal axis;

a lower ring bearing having a lower ring bearing outer race and a lower ring bearing inner race, a vertically oriented central axis of the lower ring bearing offset from the substantially vertically oriented longitudinal axis, the lower ring bearing outer race fastened to a telescoping end of the inner tube by a lower ring bearing outer race mounting plate fastened to a slide angle plate connected to the telescoping end to reciprocally move the lower ring bearing along the substantially vertically oriented longitudinal axis with the inner tube;

an upper ring bearing having an upper ring bearing outer race and an upper ring bearing inner race, a vertically oriented central axis of the upper ring bearing offset from the substantially vertically oriented longitudinal axis and the vertically oriented central axis of the lower ring bearing, the upper ring bearing outer race attached to the lower ring bearing inner race by an adjustment plate to rotate the upper ring bearing with the lower ring bearing inner race;

an arm having a first arm end and a second arm end, the arm being attached to the upper ring bearing inner race by a locking plate adjacent to the first arm end to rotate the arm about the vertically oriented central axis of the upper ring bearing;

a stopper rod depending from the second end of the arm; and a means for locking the upper ring bearing inner race in a fixed position;

whereby the stopper rod is centered in a plane over the nozzle by the combined movements of rotating the lower ring bearing inner race about the vertically oriented central axis of the lower ring bearing and rotating the upper ring bearing inner race about the vertically oriented central axis of the upper ring bearing to an aligned stopper rod position centered in the plane over the nozzle, then fixing the aligned stopper rod position by the means for locking the upper ring bearing inner race.

9. A system for controlling the flow of a molten metal in a dual pour process, the system comprising:

a molten metal holding reservoir;

a pair of spaced-apart nozzles through which the molten metal flows in the dual pour process, the pair of spaced-apart nozzles disposed in the bottom of the molten metal holding reservoir;

a pair of stopper rod positioning and control apparatus, each one of the pair of stopper rod positioning and control apparatus exclusively controlling the molten metal flow through one of the pair of spaced-apart nozzles, each one of the pair of stopper rod positioning and control apparatus comprising:

a lift apparatus centered on a substantially vertically oriented longitudinal axis, the lift apparatus having an inner tube telescopically mounted within an outer tube, the inner tube being reciprocally movable along the substantially vertically oriented longitudinal axis;

a servomotor fixedly mounted at a lower end of the outer tube, the servomotor having a servomotor output interconnected to the inner tube whereby actuation of the servomotor results in reciprocal movement of the inner tube along the substantially vertically oriented longitudinal axis;

a lower ring bearing having a lower ring bearing outer race and a lower ring bearing inner race, a vertically oriented central axis of the lower ring bearing offset from the substantially vertically oriented longitudinal axis, the lower ring bearing outer race fastened to a telescoping end of the inner tube by a lower ring bearing outer race mounting plate fastened to a slide angle support connected to the telescoping end to reciprocally move the lower ring bearing along the substantially vertically oriented longitudinal axis with the inner tube;

an upper ring bearing having an upper ring bearing outer race and an upper ring bearing inner race, a vertically oriented central axis of the upper ring bearing offset from the substantially vertically oriented longitudinal axis and the vertically oriented central axis of the lower ring bearing, the upper ring bearing outer race attached to the lower ring bearing inner race by an adjustment plate to rotate the upper ring bearing outer race with the lower ring bearing inner race;

a locking plate attached to the upper ring bearing inner race to rotate the locking plate with the upper ring bearing inner race about the vertically oriented central axis of the upper ring bearing;

a brake assembly having a means for locking the locking plate in a locked position to prevent rotation of the locking plate;

an arm having a first arm end and a second arm end, the first arm end attached to the locking plate to rotate the arm about the vertically oriented central axis of the upper ring bearing, the second arm end extending at least in the horizontal direction away from the substantially vertically oriented longitudinal axis; and a stopper rod depending from the second end of the arm;

whereby the stopper rod of each one of the pair of stopper rod positioning and control apparatus is centered in a plane over the one of the pair of spaced-apart nozzles by the combined movements of rotating the lower ring bearing inner race about the vertically oriented central axis of the lower ring bearing and rotating the upper ring bearing inner race about the vertically oriented central axis of the upper ring bearing to an aligned stopper rod position centered in the plane over the one of the pair of spaced-apart nozzles, then locking the aligned stopper rod position of each one of the pair of stopper rod positioning and control apparatus by the brake assembly, and thereafter reciprocally moving the stopper rod of each one of the pair of stopper rod positioning and control apparatus above the one of the pair of spaced-apart nozzles by actuation of the servomotor.

10. The system for controlling the flow of a molten metal in a dual pour process of claim 9 wherein the pair of spaced-apart nozzles comprise a first unitary dual nozzle block.

11. The system for controlling the flow of a molten metal in a dual pour process of claim 10 wherein the distance between the pair of spaced-apart nozzles in the first unitary dual nozzle block can be changed by replacing the first unitary dual nozzle block with a second unitary dual nozzle block having the same overall dimensions as the first single dual nozzle block, the spaced-apart distance between the pair of spaced-apart nozzles in the second unitary dual nozzle block being different from the spaced-apart distance between the pair of pair of spaced-apart nozzles in the first unitary dual nozzle block.

12. The system for controlling the flow of a molten metal in a dual pour process of claim 10, wherein at least one of the pair of stopper rod positioning and control apparatus further comprises an X-Y table with the substantially vertically oriented longitudinal axis perpendicular to the horizontal motion planes of the X-Y table so that adjustment of the X-Y table moves the substantially vertically oriented longitudinal axis in a horizontal plane to center the stopper rod of the at least one of the pair of stopper rod positioning and control apparatus in the plane over the one of the pair of spaced-apart nozzles for the at least one of the pair of stopper rod positioning and control apparatus.

13. The system for controlling the flow of a molten metal in a dual pour process of claim 11 wherein at least one of the pair of stopper rod positioning and control apparatus further comprises a linear extension element connected between the second arm end and the stopper rod to center the stopper rod of the at least one of the pair of stopper rod positioning and control apparatus in the plane over the one of the pair of spaced-apart nozzles for the at least one of the pair of stopper rod positioning and control apparatus.

14. The system for controlling the flow of a molten metal in a dual pour process of claim 9 further comprising a pair of serially indexed molds positioned below the bottom of the molten metal holding reservoir so that the sprue cup of each one of the pair of serially indexed molds is located below one of the pair of spaced-apart nozzles.

15. The system for controlling the flow of a molten metal in a dual pour process of claim 11 further comprising a pair of serially indexed molds positioned below the bottom of the molten metal holding reservoir so that the sprue cup of each one of the pair of serially indexed molds is located below one of the pair of spaced-apart nozzles, and the spaced-apart distance between the opening in the sprue cup in each one of the pair of serially indexed molds determines the distance between the pair of spaced-apart nozzles in the first or second unitary dual nozzle block.

16. The system for controlling the flow of a molten metal in a dual pour process of claim 9 further comprising a pair of molds indexed in parallel below the bottom of the molten metal holding reservoir so that the sprue cup of each one of the pair of molds indexed in parallel is located below one of the pair of spaced-apart nozzles.

17. The system for controlling the flow of a molten metal in a dual pour process of claim 11 further comprising a pair of molds indexed in parallel below the bottom of the molten metal holding reservoir so that the sprue cup of each one of the pair of molds indexed in parallel is located below one of the pair of spaced-apart nozzles, and the spaced-apart distance between the opening in the sprue cup in each one of the pair of molds indexed in parallel determines the distance between the pair of spaced-apart nozzles in the first or second unitary dual nozzle block.

18. A stopper rod positioning and control apparatus for control of molten metal flow through a nozzle disposed in a bottom of a molten metal holding reservoir, the stopper rod positioning and control apparatus comprising:

a lift apparatus centered on a substantially vertically oriented longitudinal axis, the lift apparatus having an inner tube telescopically mounted within an outer tube, the inner tube having a telescoping end and being reciprocally movable along the substantially vertically oriented longitudinal axis;

a servomotor fixedly mounted at a lower end of the outer tube, the servomotor having a servomotor output interconnected to the inner tube whereby actuation of the servomotor results in reciprocal movement of the inner tube along the substantially vertically oriented longitudinal axis;

a lower ring bearing having a lower ring bearing outer race and a lower ring bearing inner race, a central axis of the lower ring bearing offset from the substantially vertically oriented longitudinal axis;

a linear guide assembly comprising a stationary base, a sliding element and a slide angle plate, the slide angle plate passing through the substantially vertically oriented longitudinal axis, a mounting plate fastened to the upper end of the sliding element and the slide angle plate, the slide angle plate connected to the telescoping end of the inner tube and the lower ring bearing outer race attached to the mounting plate, the stationary base supporting the weight of the servomotor and lift apparatus;

an upper ring bearing having an upper ring bearing outer race and an upper ring bearing inner race, a central axis of the upper ring bearing offset from the substantially vertically oriented longitudinal axis and the central axis of the lower ring bearing, the upper ring bearing outer race attached to the lower ring bearing inner race by an adjustment plate and rotatable with the lower ring bearing inner race;

a locking plate attached to the upper ring bearing inner race and rotatable with the upper ring bearing inner race about the central axis of the upper ring bearing;

a brake assembly having a means for locking the locking plate in a locked position to prevent rotation of the locking plate;

an arm having a first arm end and a second arm end, the first arm end attached to the locking plate, the arm rotatable about the central axis of the upper ring bearing, the second arm end extending at least in the horizontal direction away from the substantially vertically oriented longitudinal axis; and a stopper rod depending from the second end of the arm;

whereby the stopper rod is aligned with the nozzle by the combined movements of rotating the lower ring bearing inner race about the central axis of the lower ring bearing and rotating the upper ring bearing inner race about the central axis of upper ring bearing to an aligned stopper rod position, then locking the aligned stopper rod position by the means for locking the locking plate in a locked position, and thereafter reciprocally moving the stopper rod above the nozzle by actuation of the servomotor.

* * * * *